US007543920B2

(12) United States Patent
Wilson, II et al.

(10) Patent No.: US 7,543,920 B2
(45) Date of Patent: Jun. 9, 2009

(54) SYSTEM AND METHOD FOR CONNECTING AN INK BOTTLE TO AN INK RESERVOIR OF AN INK JET PRINTING SYSTEM

(75) Inventors: James D. Wilson, II, Collinsville, IL (US); Charles C. Mayberry, Harvard, IL (US); Andrew Capigatti, Winfield, IL (US); Francisco V. Sanchez, Glendale Heights, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 353 days.

(21) Appl. No.: 11/031,236

(22) Filed: Jan. 6, 2005

(65) Prior Publication Data

US 2005/0151803 A1 Jul. 14, 2005

Related U.S. Application Data

(63) Continuation-in-part of application No. 29/207,871, filed on Jun. 17, 2004, now Pat. No. Des. 544,797, application No. 11/031,236, filed on Jan. 6, 2005.

(60) Provisional application No. 60/565,726, filed on Apr. 26, 2004, provisional application No. 60/535,277, filed on Jan. 9, 2004.

(51) Int. Cl.
*B41J 2/17* (2006.01)
*B41J 2/175* (2006.01)

(52) U.S. Cl. ..... 347/84; 347/85; 347/86

(58) Field of Classification Search ..... 347/86, 347/84, 85, 92, 49, 104; 215/247; 220/86.2; 222/129.1; 604/88
See application file for complete search history.

(56) References Cited

U.S. PATENT DOCUMENTS 3,334,779 A * 8/1967 Smith ..... 220/86.2
4,183,031 A 1/1980 Kyser et al.
4,610,665 A * 9/1986 Matsumoto et al. .... 604/167.04
4,700,202 A * 10/1987 Kuranishi et al. ..... 347/86
4,831,389 A 5/1989 Chan (Continued)

FOREIGN PATENT DOCUMENTS

EP 0 523 915 A2 1/1993

(Continued)

OTHER PUBLICATIONS

International Search Report for PCT/EP2005/000125, dated Apr. 28, 2005.

*Primary Examiner*—Stephen D Meier
*Assistant Examiner*—Carlos A Martinez, Jr.
(74) *Attorney, Agent, or Firm*—Kirk A. Vander Leest; McAndrews, Held & Malloy; Joseph M. Butscher

(57) ABSTRACT

An ink supply system for an ink jet printer including an ink bottle having a cap assembly secured to an outlet neck, an ink reservoir having an ink filling passage, and an insert receptacle positioned within the ink filling passage. The insert receptacle includes a probe having an inlet end and an outlet end. The system also includes an actuating assembly that is configured to mate the ink bottle with the ink reservoir by mating the cap assembly of the ink bottle with the probe of the insert receptacle.

29 Claims, 21 Drawing Sheets

U.S. PATENT DOCUMENTS 5,055,857 A 10/1991 Regnault
5,152,965 A * 10/1992 Fisk et al. ..... 422/102
5,293,913 A 3/1994 Preszler
5,343,226 A 8/1994 Niedermeyer et al.
5,348,192 A * 9/1994 Sardynski et al. ..... 222/129.1
5,429,282 A 7/1995 Stebick
5,433,330 A * 7/1995 Yatsko et al. ..... 215/247
5,454,786 A * 10/1995 Harris ..... 604/88
5,472,120 A 12/1995 Stebick et al.
5,552,816 A * 9/1996 Oda et al. ..... 347/86
5,795,369 A 8/1998 Taub
5,815,182 A 9/1998 Otis et al.
5,961,010 A 10/1999 Smith
5,975,369 A 11/1999 Yurkewicz et al.
6,022,101 A * 2/2000 Sabonis ..... 347/84
6,079,823 A 6/2000 Droege
6,164,768 A * 12/2000 Murphy et al. ..... 347/85
6,170,940 B1 * 1/2001 Shinada et al. ..... 347/86
6,190,010 B1 * 2/2001 Tanaka ..... 347/108
6,270,211 B1 * 8/2001 Long et al. ..... 347/92
6,321,924 B1 11/2001 Yurkewicz et al.
6,457,899 B1 10/2002 Lin
6,460,984 B1 * 10/2002 Matsumoto et al. ..... 347/86
6,550,894 B2 * 4/2003 Ueno et al. ..... 347/49
6,568,566 B2 5/2003 Smith
6,736,486 B2 * 5/2004 Nakamura et al. ..... 347/49
6,758,359 B2 7/2004 Yurkewicz et al.
6,779,880 B1 * 8/2004 Kulpa et al. ..... 347/86
6,799,610 B2 * 10/2004 Yuen ..... 141/2
6,854,494 B2 2/2005 Piccinino
RE38,926 E * 12/2005 Hirano et al. ..... 347/104
2001/0013884 A1 * 8/2001 Crystal et al. ..... 347/85
2002/0118259 A1 8/2002 Ranganathan et al.
2003/0121879 A1 7/2003 Smith et al.
2004/0021748 A1 * 2/2004 Hay et al. ..... 347/86
2004/0027425 A1 * 2/2004 Lee et al. ..... 347/84
2005/0011916 A1 * 1/2005 Battista et al. ..... 222/576
2005/0087548 A1 4/2005 Smith
2005/0151810 A1 * 7/2005 Graham et al. ..... 347/86

FOREIGN PATENT DOCUMENTS

FR 2 831 855 A 5/2003
JP 07246716 * 9/1995
WO WO 99/22940 5/1999

* cited by examiner

SYSTEM AND METHOD FOR CONNECTING AN INK BOTTLE TO AN INK RESERVOIR OF AN INK JET PRINTING SYSTEM

RELATED APPLICATIONS

This application is a continuation-in-part of U.S. application Ser. No. 29/207,871, entitled "Ink Bottle," which was filed on Jun. 17, 2004, now U.S. Pat. No. D, 544,797 and is hereby expressly incorporated by reference in its entirety. This application also relates to and claims priority benefits from U.S. Patent Application No. 60/535,277, entitled "System and Method for Connecting an Ink Bottle to an Ink Reservoir of an Ink Jet Printing System," which was filed on Jan. 9, 2004, and U.S. Patent Application No. 60/565,726, entitled "System and Method for Connecting an Ink Bottle to an Ink Reservoir of an Ink Jet Printing System," which was filed Apr. 26, 2004, both of which are hereby expressly incorporated by reference in their entireties.

BACKGROUND OF THE INVENTION

Embodiments of the present invention generally relate to ink jet printing systems, and more particularly to an improved system and method for connecting an ink bottle to an ink reservoir of an ink jet printing system.

Typically, ink is supplied to ink jet printing systems through the use of disposable ink bottles. The ink bottles are mounted on ink reservoirs that include a mating feature that allows ink to pass from the ink bottles into the ink reservoirs. Each ink bottle retains a finite amount of ink, typically a pint or liter of ink. As the ink jet printing system is continually used, the ink within the ink bottles is drained. When the ink bottles are fully depleted, a new ink bottle replaces the depleted ink bottle.

When the ink bottle is replaced, excess ink may spill or leak within the ink jet printing system and/or on the operator. For example, when an operator grasps the ink bottle to replace it, the force applied may squeeze the ink bottle, thereby ejecting excess ink from the bottle. Ink spills produce a mess within the ink jet printing system, and possibly outside of the system (e.g., on the surrounding flooring) and on the operator.

Thus, a need exists for a more efficient system and method of interconnecting an ink bottle to an ink reservoir. Further, a need exists for a system and method of interconnecting and separating these components together with minimal ink leakage and mess.

SUMMARY OF THE INVENTION

Certain embodiments of the present invention provide an ink supply system for an ink jet printer including an ink bottle, an ink reservoir, an insert receptacle and an actuating assembly. The ink bottle includes a cap assembly secured to an outlet neck. The ink reservoir includes an ink filling passage. The insert receptacle is positioned within the ink filling passage, wherein the insert receptacle includes a probe having an inlet end and an outlet end. The actuating assembly is configured to mate the ink bottle with the ink reservoir by mating the cap assembly of the ink bottle with the probe of the insert receptacle.

The cap assembly includes a main body having a central stud and a covering shield having an outlet. The covering shield is movably secured over the main body, wherein the central stud sealingly engages the outlet in a pre-mated position, and wherein the covering shield is moved so that the outlet is moved away from the central stud when the ink bottle is mated with the ink reservoir.

The cap assembly may include at least one clip, and the neck of the ink bottle may include a ridge. The clip is configured to snapably engage the ridge to secure the cap assembly to the neck without rotating, twisting, or screwing the cap assembly in relation to the ink bottle.

The actuating assembly may include an actuator comprising a wall having an inner surface and an outer surface, wherein a protrusion extends inwardly from the inner surface. The actuating assembly may also include a main housing having inwardly-extending guide members, wherein the actuator is rotatably retained within the main housing. The outer surface of the actuator may include at least one guide channel configured to moveably retain the guide members.

The cap assembly may include a fixed interior body, such as the main body, and a moveable covering shield positioned over the fixed interior body. The covering shield includes a groove that receives and retains the protrusion of the actuator. Movement of the actuator causes a corresponding movement in the covering shield relative to the interior body.

The actuator may be arcuate in shape, such as a semi-circular shape, and it may be configured to be rotated about a vertical axis in order to mate the ink bottle with the ink reservoir. Further, the actuating assembly may be configured to move at least a portion of the cap assembly into the probe.

Certain embodiments of the present invention also provide an ink supply system that includes an ink bottle having an ink bottle outlet configured to allow ink to pass from the ink bottle, an ink reservoir having a reservoir inlet mateable with the ink bottle outlet to allow ink to flow from the ink bottle into the ink reservoir, an ink bottle positioning member configured to align the ink bottle outlet with the reservoir inlet, and an ink bottle securing member, such as a lever, configured to pivot with respect to the ink reservoir. The ink bottle securing member supports the ink bottle above the ink reservoir in a first position. The ink bottle securing member pivots to a second position to mate the ink bottle with the ink reservoir.

The system may also include an insert receptacle having a base integrally formed with a wall defining an inner cavity therebetween. A probe having an ink passage positioned through the base is configured to pass ink from the ink bottle to the ink reservoir when the ink bottle securing member pivots to the second position. The insert receptacle may also include an ink drain formed through the base that allows excess ink retained within the inner cavity to pass into the ink reservoir.

The system may also include at least one spring member that acts to push the ink bottle away from the reservoir when the ink bottle is removed from the ink reservoir. Further, the spring member may also assist in closing the cap assembly.

The ink bottle may also include an outlet cap having a main body, a washer-like diaphragm and a split diaphragm. The probe slidably engages the diaphragms when the ink bottle is mated into the ink reservoir, such that the diaphragms sealingly engage the probe when the ink bottle is mated into the ink reservoir. The washer-like diaphragm is sandwiched between a surface of the main body of the outlet cap and the split diaphragm. The split diaphragm includes a partially formed slit, such that the probe punctures the partially formed slit to form an opening when the probe slidably engages the split diaphragm. The opening closes when the probe is removed from the split diaphragm.

The ink bottle securing member includes pins that slidably engage curved surfaces formed on the ink bottle. The pins slide over the curved surfaces toward the second position thereby urging the ink bottle toward the ink reservoir. The ink bottle securing member includes at least one bottle ejection member that supports the ink bottle above the ink reservoir in the first position.

The system may also include a bracket having a locating protuberance. Additionally, the ink bottle may include a locating feature, such as a recessed area, that is configured to mate with the locating protuberance so that the ink bottle is properly secured within the bracket.

Certain embodiments of the present invention also provide a method of connecting an ink bottle to an ink reservoir of an ink jet printer. The method includes pivoting an ink bottle positioning member relative to the ink reservoir in a first direction so that the ink bottle, which is retained by the ink bottle positioning member, is in an pre-mated position with the ink reservoir such that a mating feature of the ink bottle is aligned with a mating feature of the ink reservoir. The method also includes actuating the ink bottle into a fully mated position with the ink reservoir by pivoting an ink bottle securing member with respect to the ink reservoir in a second direction. The pivoting causes the ink bottle securing member to slide over a portion of the ink bottle, thereby exerting sufficient force to mate the ink bottle with the ink reservoir.

Further, the method may include sealingly engaging a probe that allows ink to pass from the ink bottle to the ink reservoir with at least one diaphragm, and sandwiching a first diaphragm between a second diaphragm and an interior apertured surface of an outlet of the ink bottle.

A weakened area is formed in the at least one diaphragm. The weakened area is punctured with the probe to form an opening for the probe to pass. The opening closes when the probe is removed therefrom. Additionally, the method includes suctioning excess ink between two diaphragms as the probe is removed from one of the diaphragms. The excess ink is ejected into the ink reservoir as the probe is fully disengaged from the ink bottle.

Certain embodiments of the present invention provide a method of connecting an ink bottle to an ink reservoir of a printer system, including securing a cap assembly of the ink bottle within an actuating chamber of an actuator assembly, wherein the securing includes operatively engaging the cap assembly with an actuator of the actuator assembly; and actuating the actuator in order to mate the cap assembly with a probe that allows fluid to pass into the ink reservoir. The actuating may include opening the cap assembly by moving a covering shield of the cap assembly relative to a fixed body of the cap assembly, wherein the moving comprises moving the covering shield into the probe.

The method also includes disconnecting the ink bottle from the ink reservoir by actuating the actuator in a second direction in order to move the cap assembly away from the probe. Such movement also acts to close the cap assembly.

Figure 1:
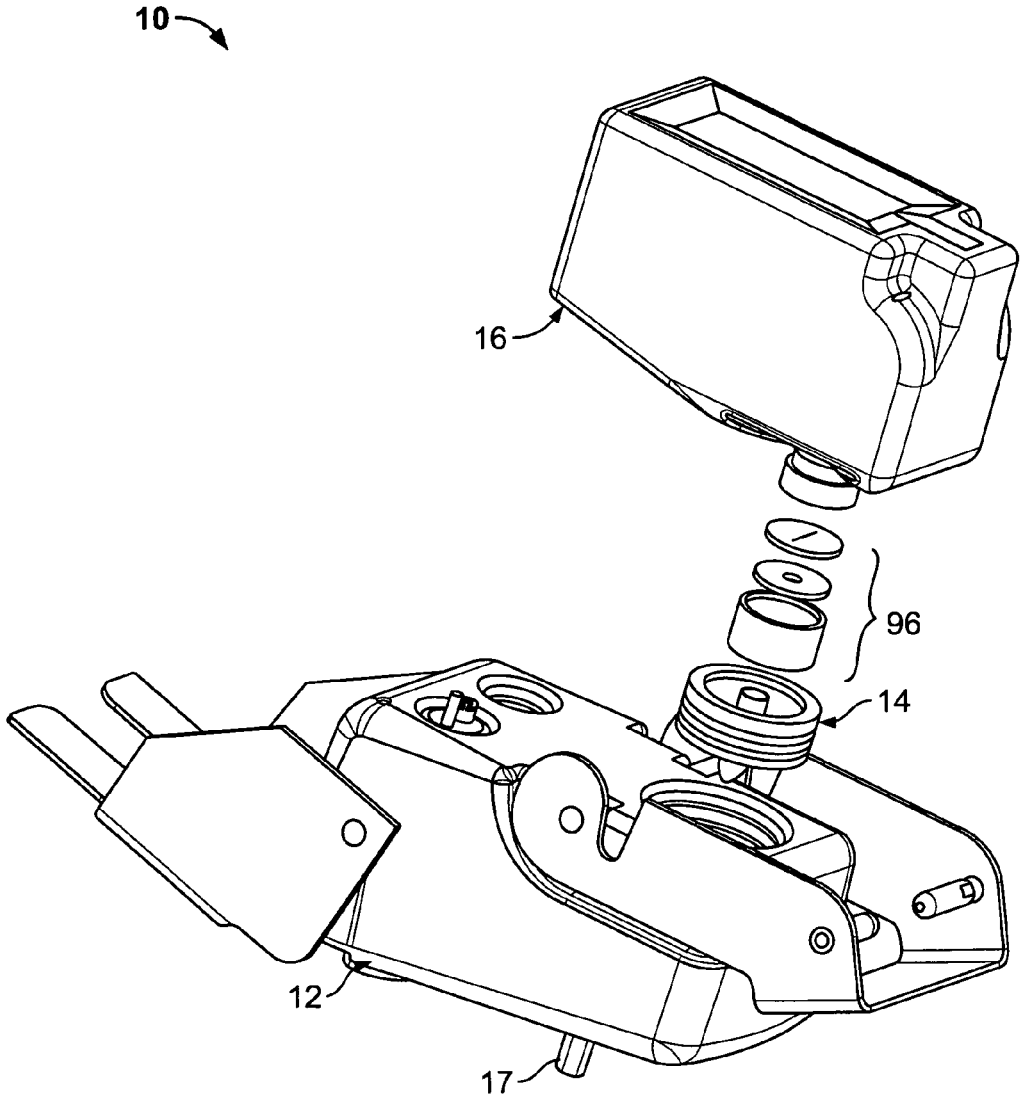
FIG. 1 illustrates an isometric exploded view of an ink bottle connection system according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric exploded view of an ink bottle connection system 10 according to an embodiment of the present invention. The system includes an ink reservoir 12, an insert receptacle 14, an ink bottle 16, and an outlet cap 96. As shown in FIG. 1, the ink reservoir 12 includes a guide post 17 that mates with a receptacle (not shown) formed within a housing (not shown) of an ink jet printing system (not shown).

Figure 2:
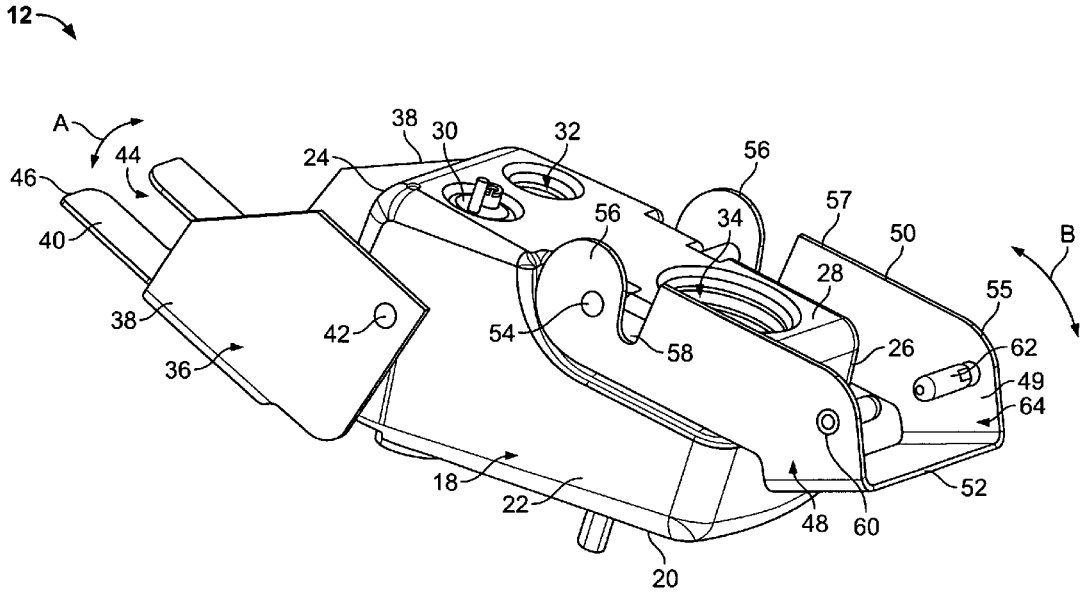
FIG. 2 illustrates an isometric view of an ink reservoir according to an embodiment of the present invention.

FIG. 2 illustrates an isometric view of the ink reservoir 12 according to an embodiment of the present invention. The ink reservoir 12 includes a main body 18 defined by a base 20 that is integrally formed with lateral walls 22, a rear wall 24, a front wall 26, and a top wall 28. The walls 22, 24, 26, 28 define an interior cavity (not shown) configured to receive and retain ink. A suction return channel 30, a level sensing channel 32, and an ink filling passage 34 are formed through the top wall 28 and provide fluid conduits between the ink reservoir 12 and other components, such as an ink bottle (discussed below). The insert receptacle 14 is dimensioned to fit within the ink filling passage 34. Optionally, the insert receptacle 14 may be integrally formed with the ink reservoir 12 or the ink bottle 16.

An ink bottle positioning member 36 is positioned proximate the rear wall 24 of the ink reservoir 12. The ink bottle positioning bracket or member 36 includes lateral walls 38 integrally formed with an ink bottle guide wall 40. The lateral walls 38 include guide posts 42 that pivotally engage positioning member receptacles (not shown) formed in the lateral walls 22 of the ink reservoir 12, thereby allowing the ink bottle positioning member 36 to pivot or rotate relative to the ink reservoir 12 through an arcuate path defined by A. The ink bottle guide wall 40 includes a neck engaging groove 44 formed through a distal end 46 of the ink bottle guide wall 40.

An ink bottle securing member 48 is positioned proximate the front wall 26 of the ink reservoir 12. The ink bottle securing lever or member 48 includes lateral walls 50 integrally formed with a handle 52 that connects the lateral walls 50 together. The lateral walls 50 include pivotal guide posts 54 that are rotatably retained by receptacles (not shown) formed in the lateral walls 22 of the ink reservoir 12, thereby allowing the ink bottle securing member 48 to pivot relative to the ink reservoir 12 over an arcuate path defined by B. The proximal ends of the lateral walls 50 of the ink bottle securing member 38 also include cam-shaped bottle ejection members 56. When the ink bottle securing member 48 is pivoted in an non-engaged position as shown in FIG. 2, the cam shaped bottle ejection members 56 extend above the guide posts 54 and edges 57 of the lateral walls 50. Notches 58 are also formed in the lateral walls 50. Pin cavities 60 are formed in distal ends 55 of the lateral walls 50. The pin cavities 60 are configured to receive and retain pins 62 that extend inwardly from distal interior surfaces 49 the lateral walls 50, and into a bottle engaging area 64.

Alternatively, a locking cam member may be connected to the ink bottle securing member 48. The locking cam member may be configured to pivot through a range of motion that opposes that of the ink bottle securing member 48. The locking cam member may be used to securely lock the ink bottle 16 into place with respect to the ink reservoir 12.

Figure 3:
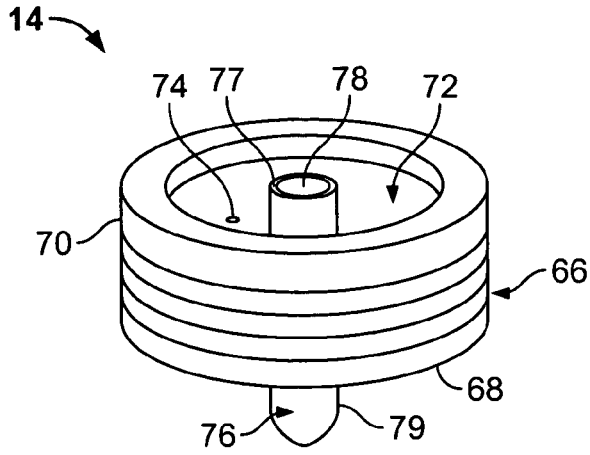
FIG. 3 illustrates an isometric view of an ink filling cap according to an embodiment of the present invention.

FIG. 3 illustrates an isometric view of the insert receptacle 14, which is configured to be received and retained by the ink filling passage 34. The insert receptacle 14 includes a generally cylindrical main body 66 that includes a base 68 integrally formed with a cylindrical wall 70, thereby defining an inner cavity 72 therebetween. The cylindrical main body 66 is formed to fit in a reciprocal opening formed in the top wall 28 (shown, e.g., in FIG. 2) of the ink reservoir 12 (shown, e.g., in FIG. 2). That is, the top wall 28 includes a recessed base portion surrounding an opening that supports the cylindrical main body 66 and base 68 of the insert receptacle 14. An ink drain 74 is formed through the cylindrical wall 70 and/or the base 68 and is configured to allow ink that is collected in the inner cavity 72 to drain into the ink reservoir 12 through the ink filling passage 34 (shown, e.g., in FIG. 2). A probe 76 is positioned in the center of the base 68 and is generally perpendicular to the plane of the base 68. As shown in FIG. 3, the probe 76 extends through the base 68. The probe 76 is a tube-like structure having an ink passage 78 that extends through the entire length of the probe 76. The probe 76 includes an inlet end, or ink bottle mating end 77 and an outlet end, or ink reservoir deposit end 79. The ink reservoir deposit end 79 is beveled in order to prevent ink from overflowing. For example, the ink reservoir deposit end 79 may be beveled, or scalloped, similar to the needle shown and described in greater detail in FIG. 3 of U.S. Pat. No. 4,831,389. Optionally, the insert receptacle 14 may include more than one ink drain 74.

Figure 4:
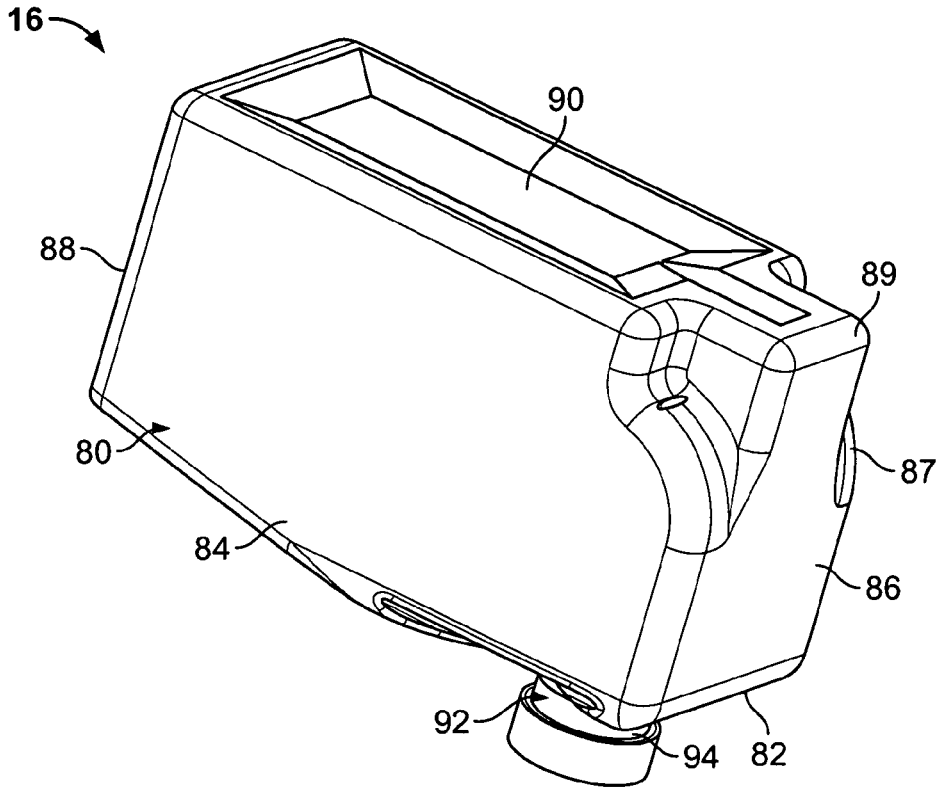
FIG. 4 illustrates an isometric view of an ink bottle according to an embodiment of the present invention.

FIG. 4 illustrates an isometric view of the ink bottle 16, which is configured to contain and dispense ink. The ink bottle 16 includes a main body 80 defined by a base 82, lateral walls 84, a front wall 86, a rear wall 88, and a top wall 90. The front wall 86 includes curved pin sliding surfaces 87 formed on either side of a central block 89. An ink outlet 92 extends downwardly from the base 82. The ink outlet 92 includes a neck 94 having a channel (not shown) extending therethrough that is in fluid communication with the interior (not shown) of the ink bottle 16. The outlet cap 96 (shown in FIG. 1) has an outlet positioned over at least a portion of the neck 94. As further discussed below, the outlet cap 96 is configured to mate with the ink bottle mating end 77 of the probe 76. That is, the outlet cap 96 fits within the inner cavity 72 of the insert receptacle 14 so that the outlet of the outlet cap 96 aligns with the ink passage 78. Thus, ink may pass from the ink bottle 16 through the outlet of the neck 94 and outlet cap 96 through the ink passage 78 of the probe 76, and into the ink reservoir 12.

Figure 5:
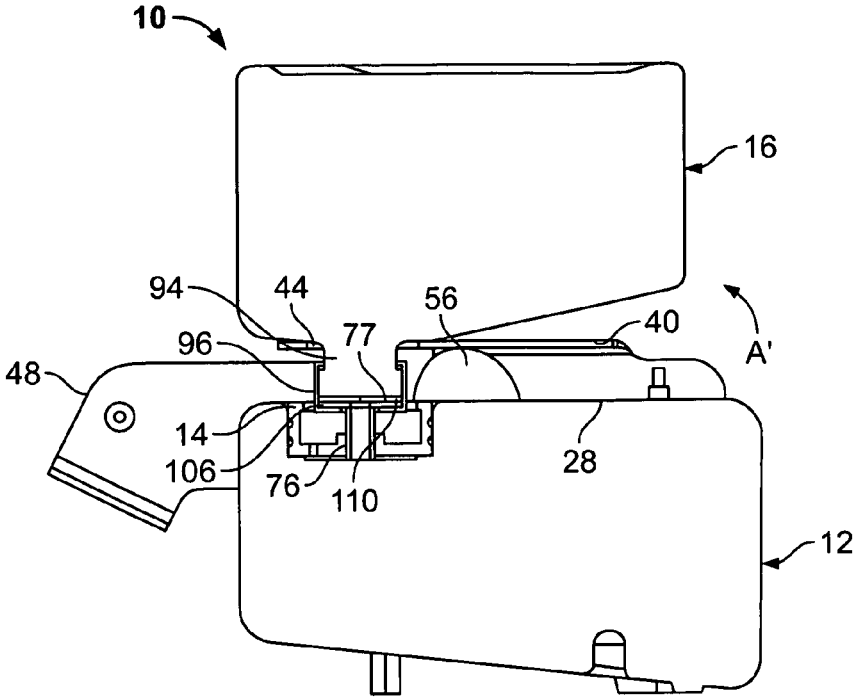
FIG. 5 illustrates a transverse cross-sectional view of an ink bottle connection system during an ink bottle positioning stage, according to an embodiment of the present invention.

FIG. 5 illustrates a transverse cross-sectional view of an ink bottle connection system 10 during an ink bottle positioning stage. The ink bottle positioning member 36 has been pivoted in the direction of A' so that the ink bottle guide wall 40 is positioned over the top wall 28 of the ink reservoir 12. As shown in FIG. 5, the neck 94 of the ink bottle 16 is positioned within the neck engaging groove 44. That is, the neck 94 is configured to be removably secured within the neck engaging groove 44. The neck engaging groove 44 is formed so that when the neck 94 is inserted into the neck engaging groove 44, the outlet cap 96 is aligned to mate with the insert receptacle 14, i.e., the ink bottle 16 is aligned to mate with the ink reservoir 12. The outlet cap 96 is not mated with the insert receptacle 14 at this stage because the bottle ejection members 56 abut the ink bottle guide wall 40, thereby supporting the ink bottle guide wall 40 in a pre-mated state over the top wall 28 of the ink reservoir 12. Thus, the outlet cap 96 is, in turn, supported in a pre-mated state.

Figure 6:
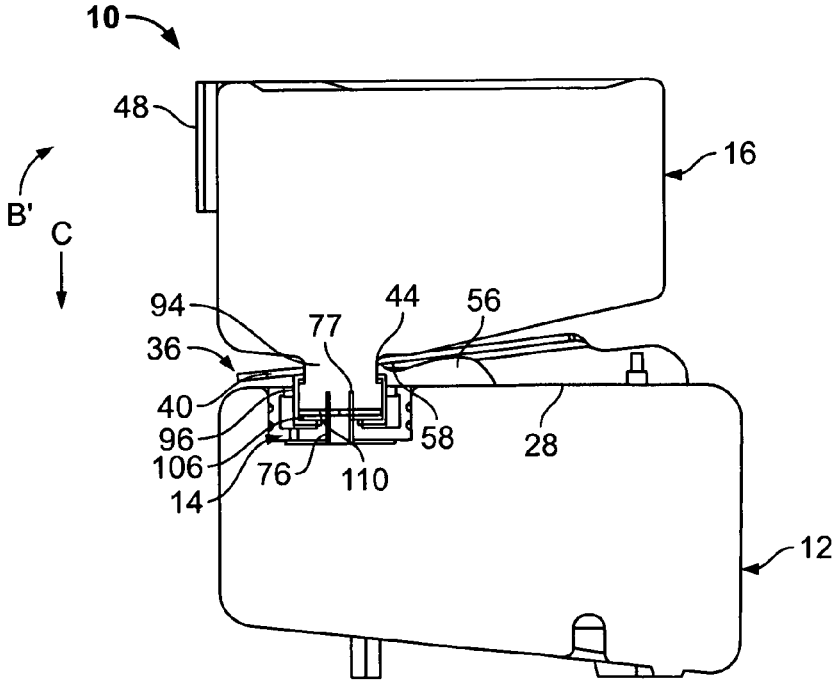
FIG. 6 illustrates a transverse cross-sectional view of an ink bottle connection system at a fully mated position according to an embodiment of the present invention.
Figure 7:
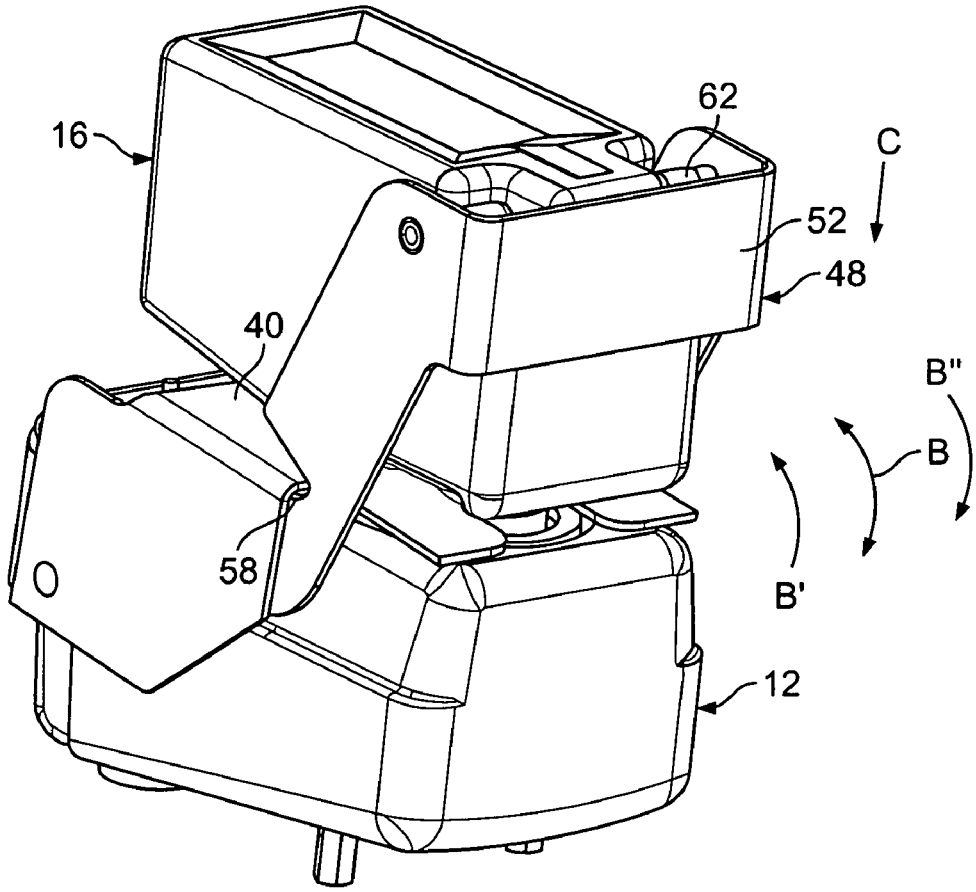
FIG. 7 illustrates an isometric view of an ink bottle connection system at a fully mated position according to an embodiment of the present invention.

FIGS. 6 and 7 illustrate the ink bottle connection system 10 at its fully mated position. As can best be seen in FIG. 7, the ink bottle securing member 48 has been pivoted upwards in the direction of B'. Referring to FIGS. 6 and 7, as the ink bottle securing member 48 pivots upward in the direction of B', the bottle ejection members 56 recede from and disengage the ink bottle guide wall 40, thereby allowing the ink bottle 16 to move downwardly in the direction of C toward the top wall 28 of the ink reservoir 12. Consequently, the ink bottle 16 is mated with, or connects with, the ink reservoir 12 by way of the neck 94 and outlet cap 96 mating with the insert receptacle 14. As the ink bottle securing member 48 continues to travel upwardly in the direction of B', the outlet cap 96 further mates with the insert receptacle 14. The notches 58 of the ink bottle securing members 48 move into a straddling relationship with the ink bottle guide wall 40. Further, the pins 62 slide over the curved surfaces 87 (as shown in FIG. 4), which are shaped to conform to the arcuate movement of the pins 62 in the directions defined by B. As the pins 62 slide over the curved surfaces 87, the pins exert a downward force on the ink bottle 16 causing the outlet cap 96 to fully mate with the insert receptacle 14. When the ink bottle 16 and ink reservoir 12 are in a fully mated position, the force exerted by the pins 62 in the direction of C assists in securely maintaining a connection between the ink bottle 16 and the ink reservoir 12.

In order to disengage the ink bottle 16 from the ink reservoir 12, the handle 52 is pulled down in the direction of B". As the handle 52 moves in the direction of B", the entire ink bottle securing member 48 moves in response thereto. Thus, the bottle ejection members 56 move upward and abut the ink bottle guide wall 40 causing the ink bottle guide wall 40 to move upward. As the ink bottle guide wall 40 moves upward, the outlet cap 96 is ejected from the insert receptacle 14 due to the fact that the ink bottle guide wall 40, which supports the ink bottle 16, urges the ink bottle 16 upward.

Because the ink bottle 16 is removed without an operator grasping the ink bottle 16 itself, the ink bottle 16 is not squeezed. Thus, excess ink is not ejected from the ink bottle 16. Further, excess ink may collect in the inner cavity 72 (as shown in FIG. 3) of the insert receptacle 14 and drain into the ink reservoir 12 through the ink drain 74 (as shown in FIG. 3). Thus, embodiments of the present invention provide a system 10 and method of removing the ink bottle 16 from the reservoir 12 with a minimal amount of ink residue, spillage, and mess.

Figure 8:
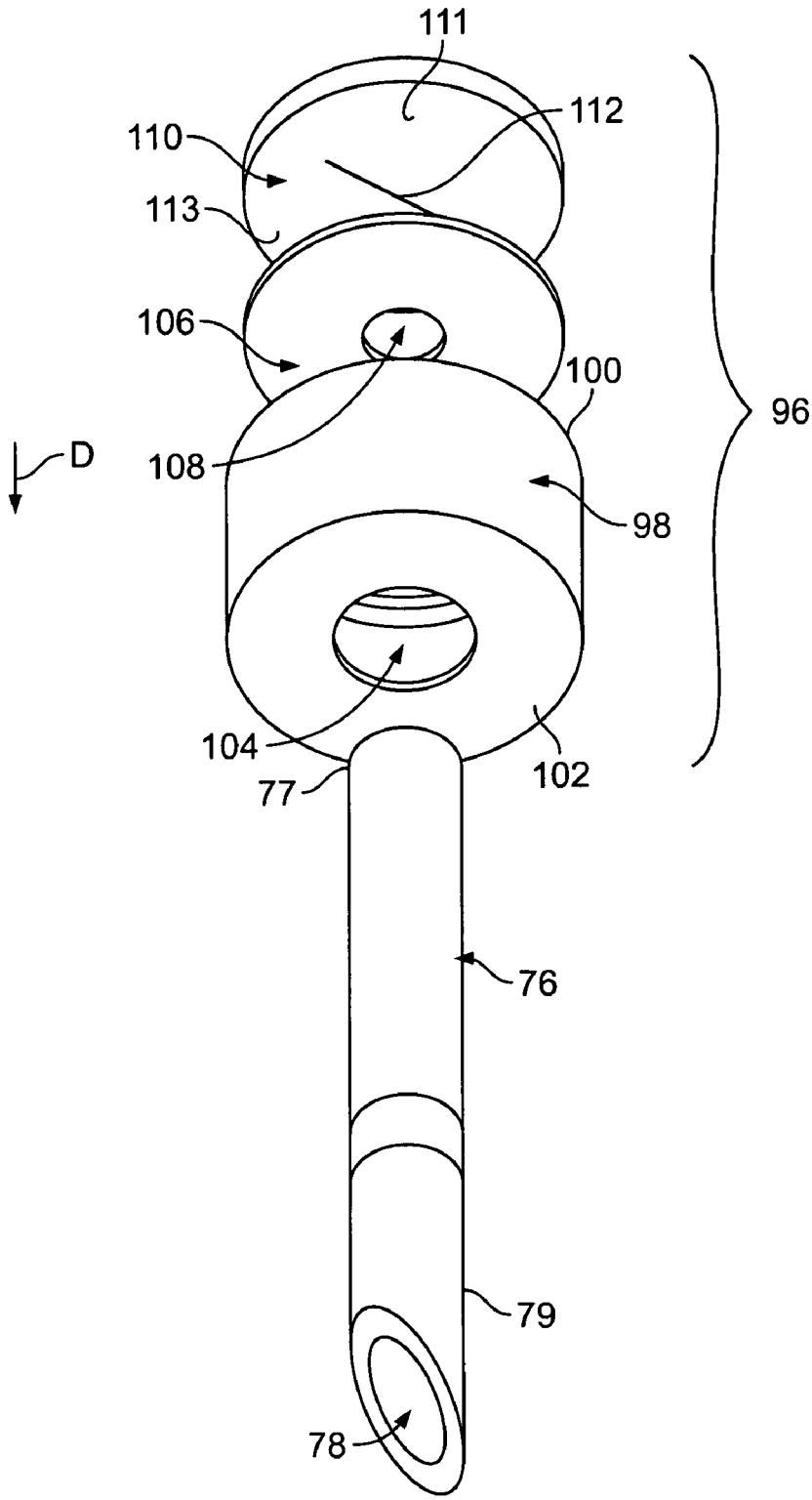
FIG. 8 illustrates an isometric exploded view of a outlet cap according to an embodiment of the present invention.

FIG. 8 illustrates an isometric exploded view of an outlet cap 96 and a probe 76. For the sake of clarity, the main body 66 of the insert receptacle 14 is not shown. Referring to FIG. 8 (and also to FIGS. 5 and 6), the outlet cap 96 includes a main cylindrical body 98 having an open end 100 that is configured to securely engage the neck 94 of the ink outlet 92, and a partially closed end 102 having a passage 104 formed therethrough. A washer-like diaphragm 106 having a passage 108 formed therethrough is positioned within a cavity formed within the cylindrical body 98. A split diaphragm 110 is positioned over the diaphragm 106 so that the diaphragm 106 is sandwiched between an upper surface of the interior of the cylindrical body 98 and the split diaphragm 110. A partial slit 112 is formed on the bottom face of the split diaphragm 110 between sides 111 and 113. The slit 112 may be a perforation or similar area of structural weakness. Preferably, the slit 112 does not fully extend through the diaphragm 110 except upon being engaged by a puncturing member. The outlet cap 96 may be attached to the neck 94 of the ink bottle 16 by various methods including clipping, crimping, screwing, bonding, and the like. For example, the outlet cap 96 may threadably or snapably engage a corresponding structure on the neck 94. The diaphragms 106 and 110 may be formed of an elastomeric material or various other resilient, liquid tight and gas tight materials. Alternatively, the outlet cap 96 may include only one of the diaphragms 106 or 110. Also, alternatively, the outlet cap 96 may include additional diaphragms 106 and 110. A further alternative embodiment of the ink bottle connection system 10 may include a puncturable diaphragm closure such as described in U.S. Pat. No. 6,079,823, entitled "Ink Bottle With Puncturable Diaphragm Closure," which is hereby incorporated by reference in its entirety.

Each of the diaphragms 106 and 110 has a particular surface energy that is less than the surface tension of the ink contained within the ink bottle 16. Thus, droplets of ink are substantially prevented from leaking through the diaphragms 106 and 110. For example, the surface energy of the diaphragms 106 and 110 may be about 20 dyne/cm, while the surface tension of the ink is about 35 dyne/cm.

During a mating process between the outlet cap 96 and the insert receptacle 14, the ink bottle mating end 77 of the probe 76 passes through the passage 104 of the outlet cap 96. After passing through the passage 104, the ink bottle mating end 77 slidably passes through the passage 108 of the diaphragm 106. The slidable engagement between the probe 76 and the opening 108 forms a liquid tight and gas tight seal due to the fact that the opening 108 has a smaller diameter than the diameter of the ink passage 78 of the probe 76. As the probe 76 slides through the opening 108, the diaphragm 106 clings to the outer surface of the probe 76, thereby sealingly engaging the probe 76.

As the probe 76 slides further into the outlet cap 96, the probe engages the split diaphragm 110. The split diaphragm 110 has a thin membrane on its outer surface, which is formed by an incomplete formation of the slit 112. As the probe 76 is urged into the slit 112, the slit 112 is punctured and tears along a distance that allows the probe 76 to fully pass through the slit 112. The remaining untorn portion of the slit 112 clings or conforms to the exterior of the probe 76, thereby providing a barrier against leaks. That is, the spilt diaphragm 110 clings to the outer surface of the probe 76, thereby sealingly engaging the probe 76. The probe 76 preferably passes through the diaphragm 110 a distance that allows a maximum amount of ink to pass from the ink bottle 16 into the probe 76. That is, the probe 76 is sized so to minimize the effects of damming within the ink bottle 16.

As the probe 76 is slidably disengaged from the outlet cap 96, the diaphragms 106 and 110 cling to the outer walls of the probe 76. The diaphragm 106 everts, or moves downward in the direction of D. The eversion of the diaphragm 106 causes excess fluid retained above and below the diaphragm 110 to be suctioned or funneled into a space between the diaphragm 106 and the diaphragm 110. After the probe 76 fully disengages from the outlet cap, the sides 111 and 113 of the diaphragm 110 snap back together due to the nature of the elastomeric material that forms the diaphragm 110, thereby closing the slit 112.

Any fluid remaining between the diaphragms 106 and 110 remains in place until the probe 76 disengages from the diaphragm 106. After full disengagement, the passage 108 acts as an orifice that ejects the remaining fluid into the probe 76 (and consequently, into the ink reservoir 12) as the diaphragm 106 snaps back into place against the diaphragm 110. Any additional fluid remaining in the ink bottle 16 remains in the ink bottle 16 because of the fluid tight and gas tight barrier formed by closing of the slit 112 of the diaphragm 110. Thus, the outlet cap 96 prevents fluid leaks and mess.

Figure 9:
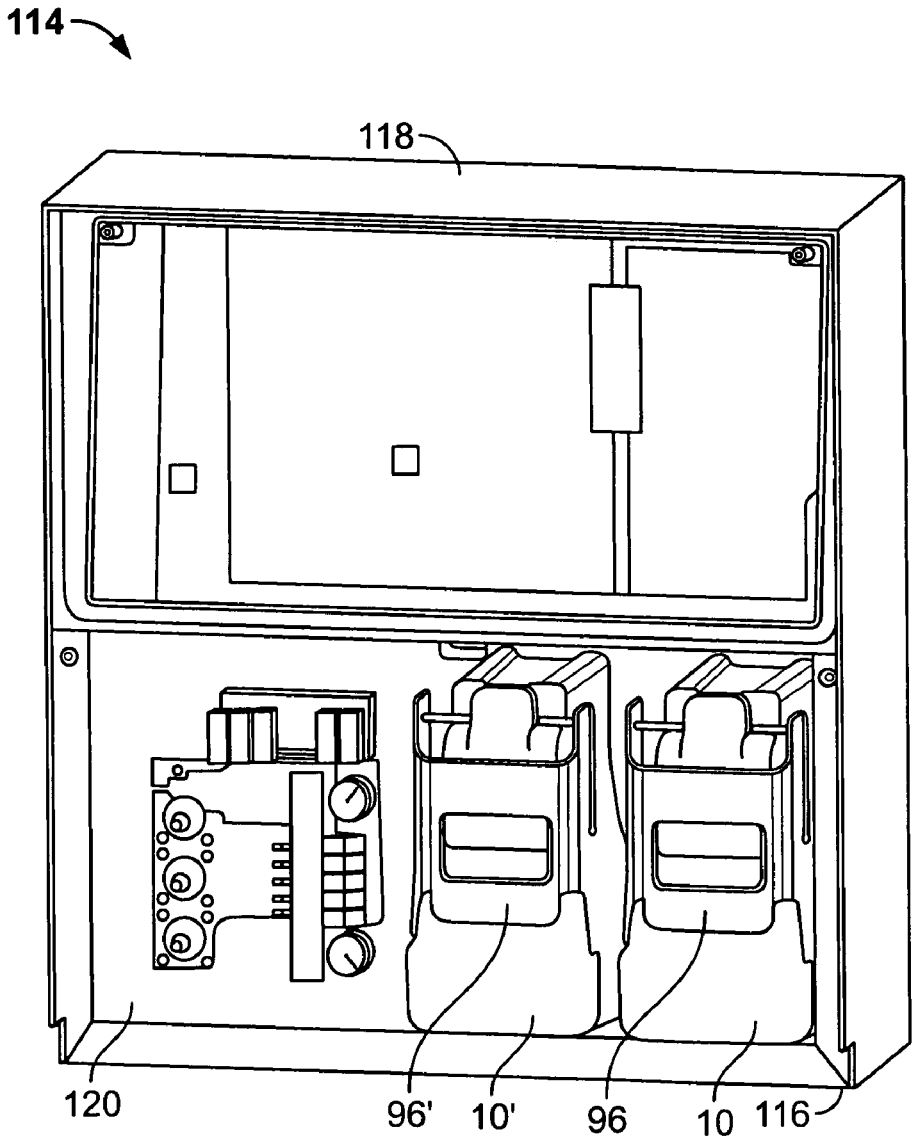
FIG. 9 illustrates an isometric view of an ink jet printing system according to an embodiment of the present invention.
Figure 10:
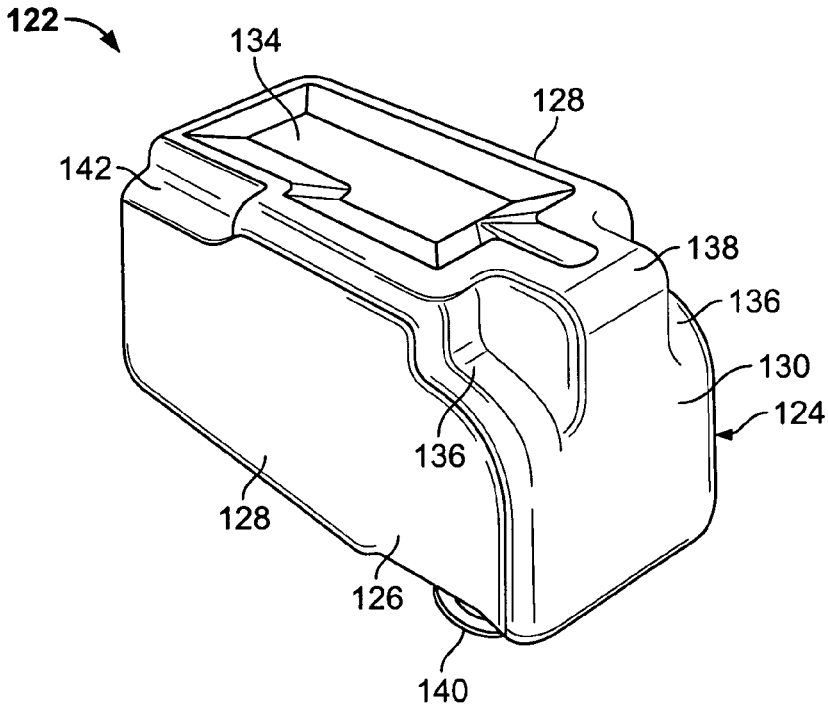
FIG. 10 illustrates an isometric top view of an ink bottle configured to be used with an ink jet printer, according to an embodiment of the present invention.
Figure 11:
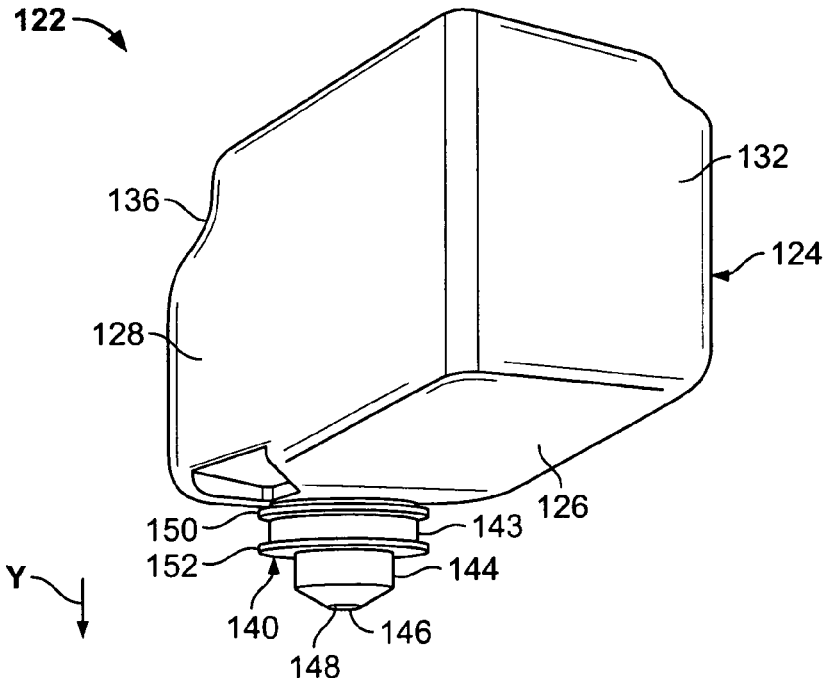
FIG. 11 illustrates an isometric bottom view of the ink bottle, according to an embodiment of the present invention.
Figure 12:
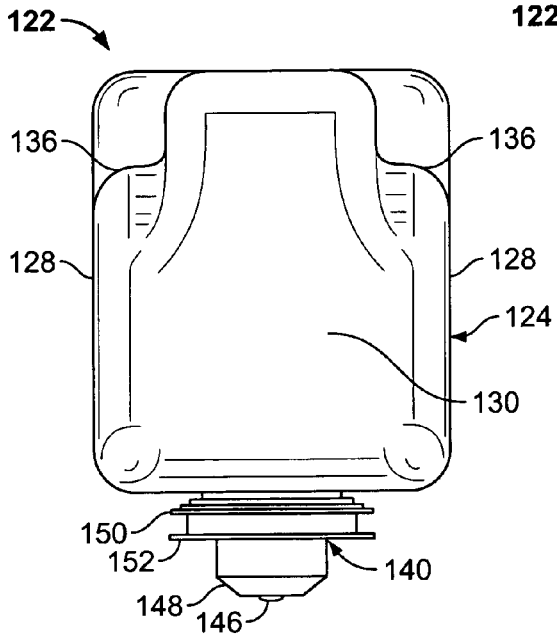
FIG. 12 illustrates a front elevation view of the ink bottle, according to an embodiment of the present invention.
Figure 13:
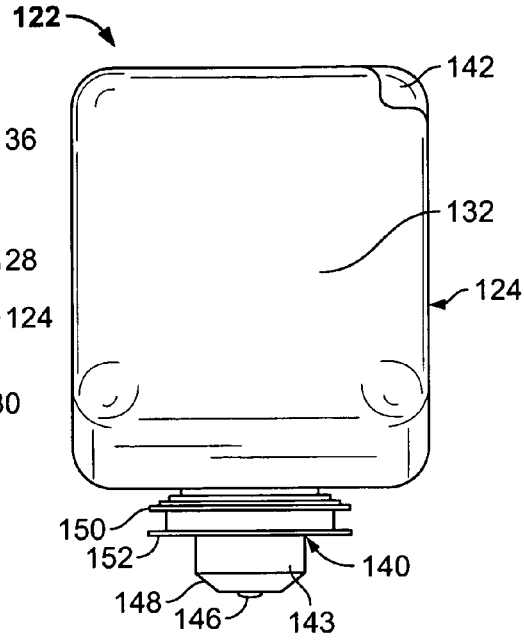
FIG. 13 illustrates a rear elevation view of the ink bottle, according to an embodiment of the present invention.
Figure 14:
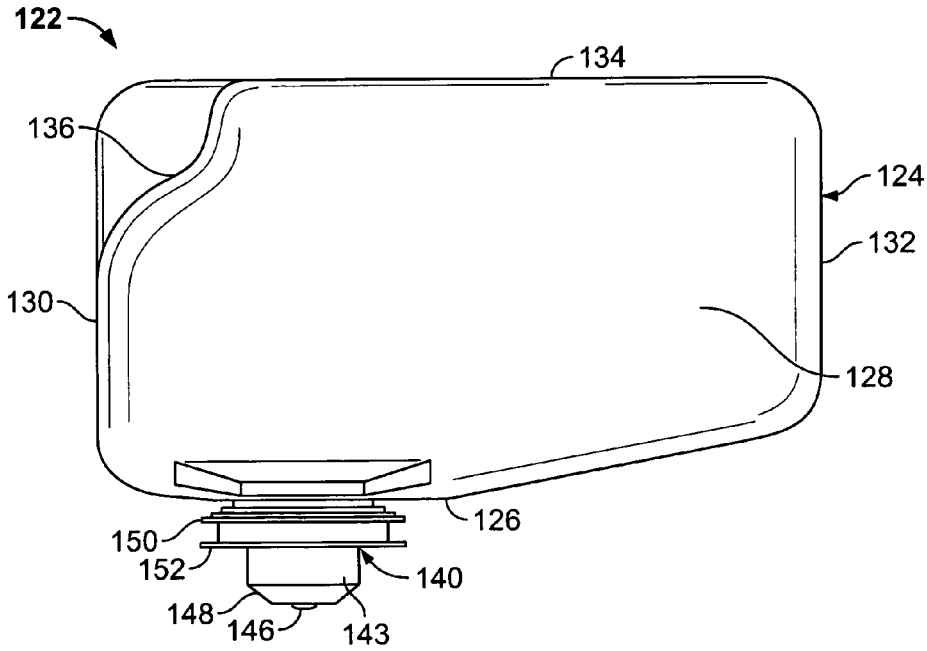
FIG. 14 illustrates a first lateral elevation view of the ink bottle, according to an embodiment of the present invention.
Figure 15:
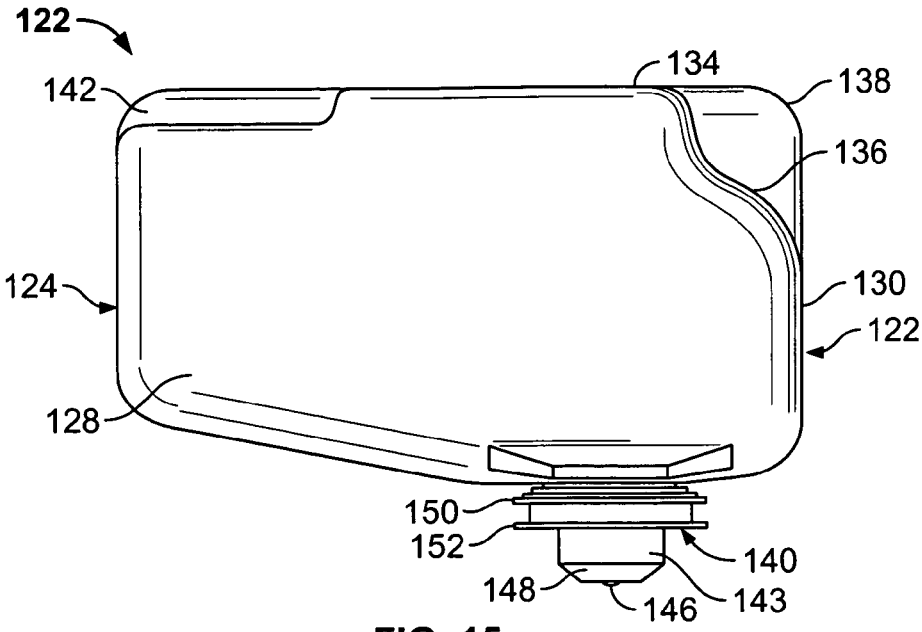
FIG. 15 illustrates a second lateral elevation view of the ink bottle, according to an embodiment of the present invention.
Figure 16:
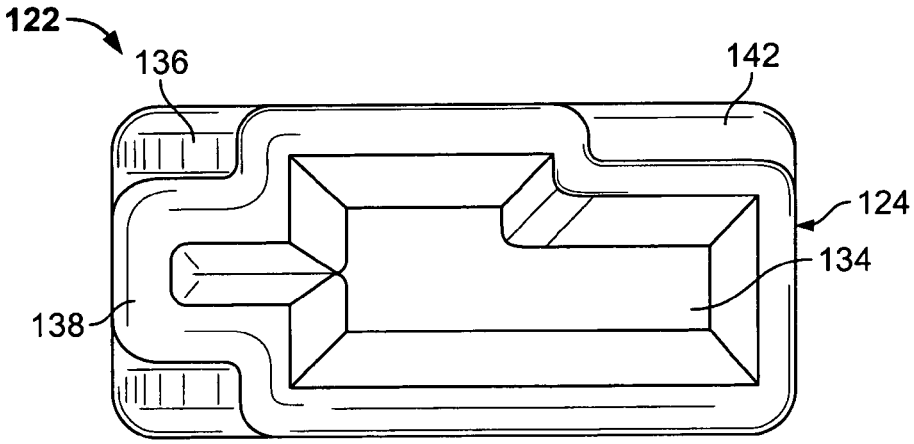
FIG. 16 illustrates a top plan view of the ink bottle, according to an embodiment of the present invention.
Figure 17:
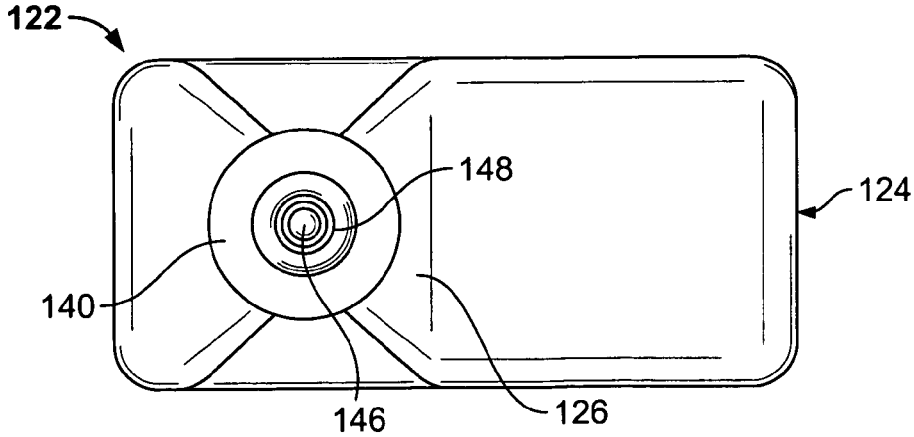
FIG. 17 illustrates a bottom plan view of the ink bottle, according to an embodiment of the present invention.

FIG. 9 illustrates an isometric view of an ink jet printing system 114 according to an embodiment of the present invention. The system 114 includes a housing 116 that contains a printing chamber 118, a control unit 120, and ink bottle connection systems 10 and 10'. One of the ink bottle connection systems 10 may be used for supplying ink, while the other ink bottle connection system 10' may be used for supplying make-up fluid. The mating structures on the ink bottle connection systems 10 and 10' may be different. That is, the outlet caps 96 (discussed above) for the systems 10 and 10' may differ such that each may only mate with an insert receptacle 14 (discussed above) of its respective system 10 and 10'. Optionally, the outlet cap 96 of the system 10' may not mate with the insert receptacle 14 of the system 10, but the outlet cap 96 of the system 10 may mate with the insert receptacle 14 of the system 10', or vice versa.

Additionally, the system 114 may include brackets mounted in the interior of the housing 116 that mate with the ink bottles 16 and 16'. The brackets may assist in securing the ink bottles 16 and 16' within the housing 116. Further, the brackets may be keyed to accept only a certain type of ink bottle 16 or 16'.

FIGS. 10-17 illustrate an ink bottle 122 configured to be used with an ink jet printer, according to an embodiment of the present invention. The ink bottle 122 includes a main body 124 defined by a base 126, lateral walls 128, a front wall 130, a rear wall 132, and a top wall 134. The front wall 130 includes curved pin sliding surfaces 136 formed on either side of a central block 138. An ink outlet (not shown) extends downwardly from the base 126. The ink outlet includes a neck (not shown) having a channel (not shown) extending therethrough that is in fluid communication with the interior (not shown) of an ink bottle. The neck may be similar to the neck 94, shown, e.g., in FIG. 4. A cap assembly 140 is disposed over the neck. As further discussed below, the cap assembly 140 is configured to mate with a probe of an insert receptacle, such as insert receptacle 14, shown, e.g., in FIG. 3. Thus, ink may pass from the ink bottle 122 through the cap assembly 140, and into the ink reservoir.

The ink bottle 122 also includes a recess 142 located proximate the junction of a lateral wall 128, the top wall 134 and the rear wall 132. While the recess 142 is shown at the top of the ink bottle 122, the recess 142 may be located at various other positions of the ink bottle 122. For example, the recess 142 may be located on the top wall 134, or on the rear wall 132, or solely on one of the lateral walls 128. Additionally, more than one recess 142 may be formed on the ink bottle 122. The recess 142 acts as a locating feature that mates with a reciprocal protuberance formed on a housing bracket on an ink jet printing system. Optionally, the ink bottle 122 may include a protuberance that mates with a reciprocal recess formed in the housing bracket.

The cap assembly 140 includes a generally cylindrical main body 143 having a beveled tip 144 extending downwardly therefrom. An ink outlet passage 146 is formed at the distal end 148 of the beveled tip 144. The main body 143 also includes an upper circumferential ridge 150 extending outwardly therefrom, and a lower circumferential ridge 152 spaced apart from the upper circumferential ridge 150 and extending outwardly from the main body 143. The upper circumferential ridge 150 is located proximate the base 126 of the ink bottle 122, while the lower circumferential ridge 152 is distally located from the base 126.

The cap assembly 140 is shown in a closed position. In order to allow ink to flow from the ink bottle 122 through the cap assembly 140, the cap assembly 140 is urged in the direction of arrow Y shown in FIG. 11. As the cap assembly 140 is slid open in the direction of Y, an inner channel is opened and ink is allowed to pass through the ink outlet passage 146. An exemplary cap assembly is further described with respect to FIGS. 23-25.

Figure 18:
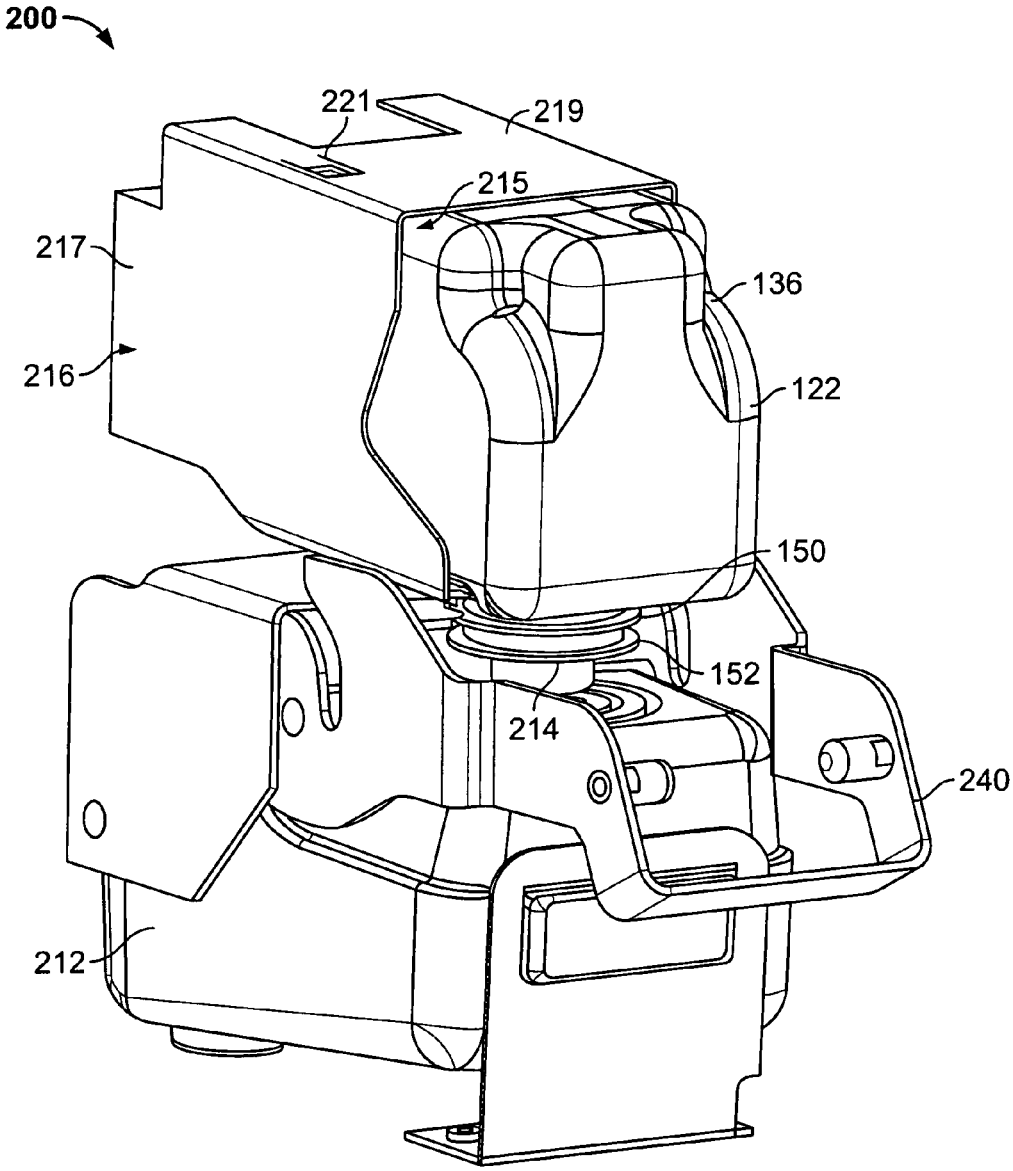
FIG. 18 illustrates an isometric view of an ink bottle connection system during an ink bottle positioning stage, according to an embodiment of the present invention.

FIG. 18 illustrates an isometric view of an ink bottle connection system 200 during an ink bottle positioning stage, according to an embodiment of the present invention. The system 200 includes the ink bottle 122 configured to be mated with an ink reservoir 212, similar to the embodiments discussed above. The ink bottle 122 is secured within a bracket 216 of an ink jet printing system. The bracket 216 includes lateral walls 217 integrally formed with a top wall 219 defining an interior cavity 215 therebetween. The top wall 219 includes a protuberance 221 that extends into the interior cavity 215. The ink bottle 122 is positioned within the interior cavity 215 such that the protuberance 221 is mated into the recess 142 (shown in FIG. 10, for example). The mating of the protuberance 221 into the recess 142 ensures that appropriate ink bottles 122 are used with the system 200. In other words, if a particular ink bottle does not include a recess 142 that is configured to mate with the protuberance 221, that ink bottle cannot be secured within the interior cavity 215, and therefore, not used with the system 200.

Figure 19:
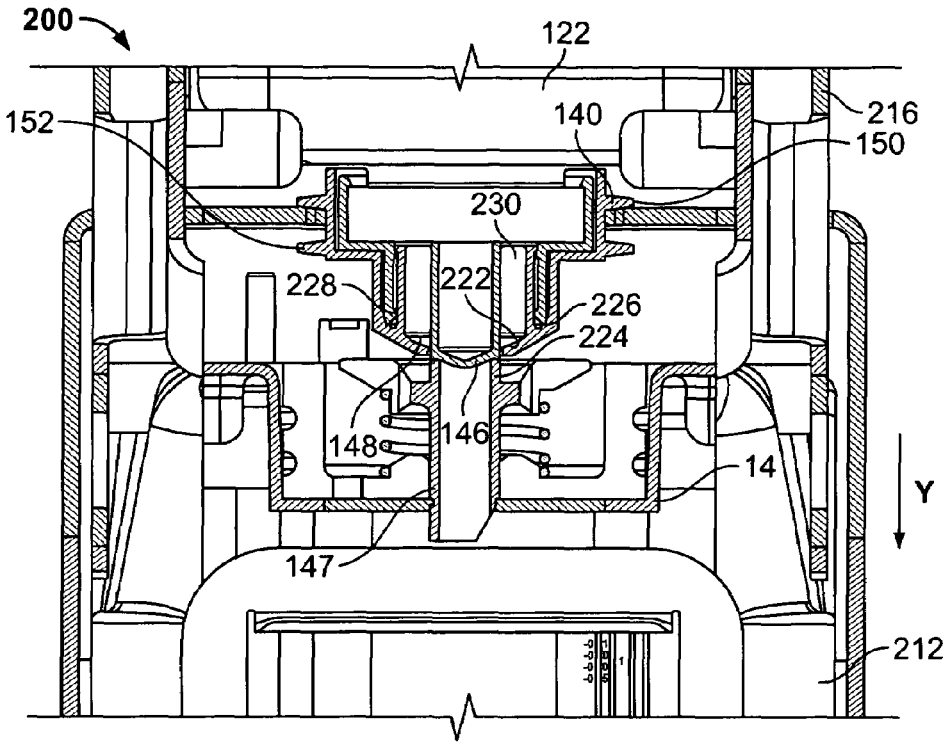
FIG. 19 illustrates an interior cross-sectional view of an ink bottle connection system during an ink bottle positioning stage, according to an embodiment of the present invention.

FIG. 19 illustrates an interior cross-sectional view of the ink bottle connection system 200 during an ink bottle positioning stage, according to an embodiment of the present invention. The cap assembly 140 includes a wiper seal 222 positioned at the distal end 148. Below the wiper seal 222 is an annular interference member 224 at full closure that is adapted to be the main pressure seal. An additional seal 226 is configured to wipe an inner lumen 228 and is a primary seal when the enclosure is fully opened and closed. An additional seal may be an interference member between the tip of the lumen and the internal cylinder of the closure tip. When the cap assembly 140 is urged open in the direction of arrow Y, ink is allowed passes from the ink bottle 122, through an ink channel 230 of cap assembly 140 and out the ink outlet passage 146. The ink then passes into the ink reservoir 212 by way of the insert receptacle 14. The cap assembly 140 may be similar to the cap assembly shown in FIGS. 23-25.

Figure 21:
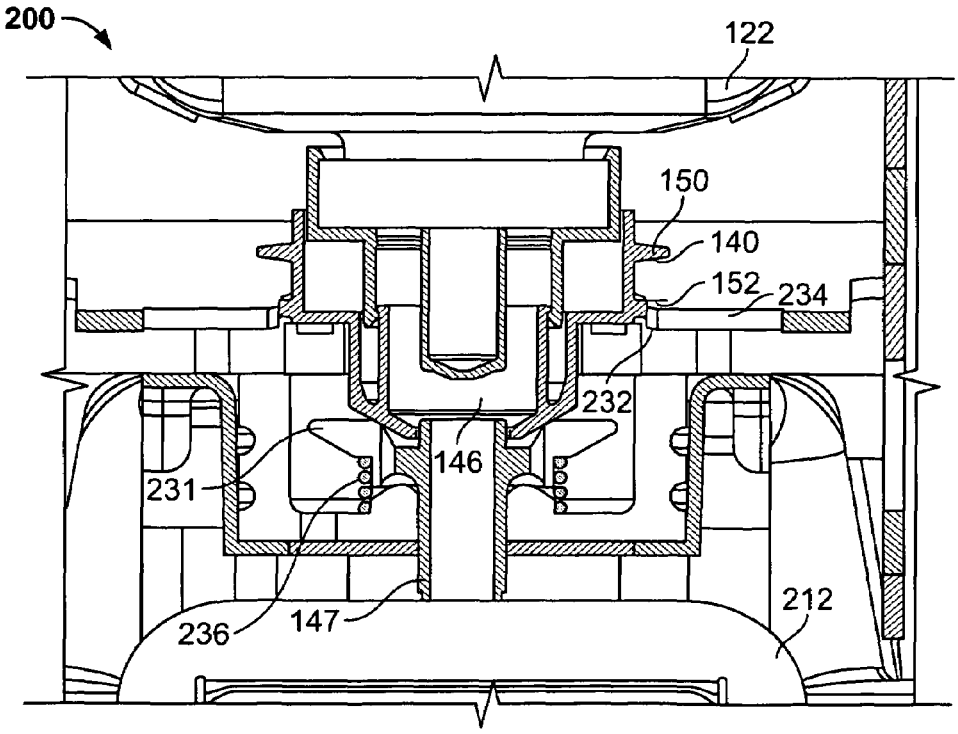
FIG. 21 illustrates an interior cross-sectional view of an ink bottle connection system at a fully mated position, according to an embodiment of the present invention.
Figure 20:
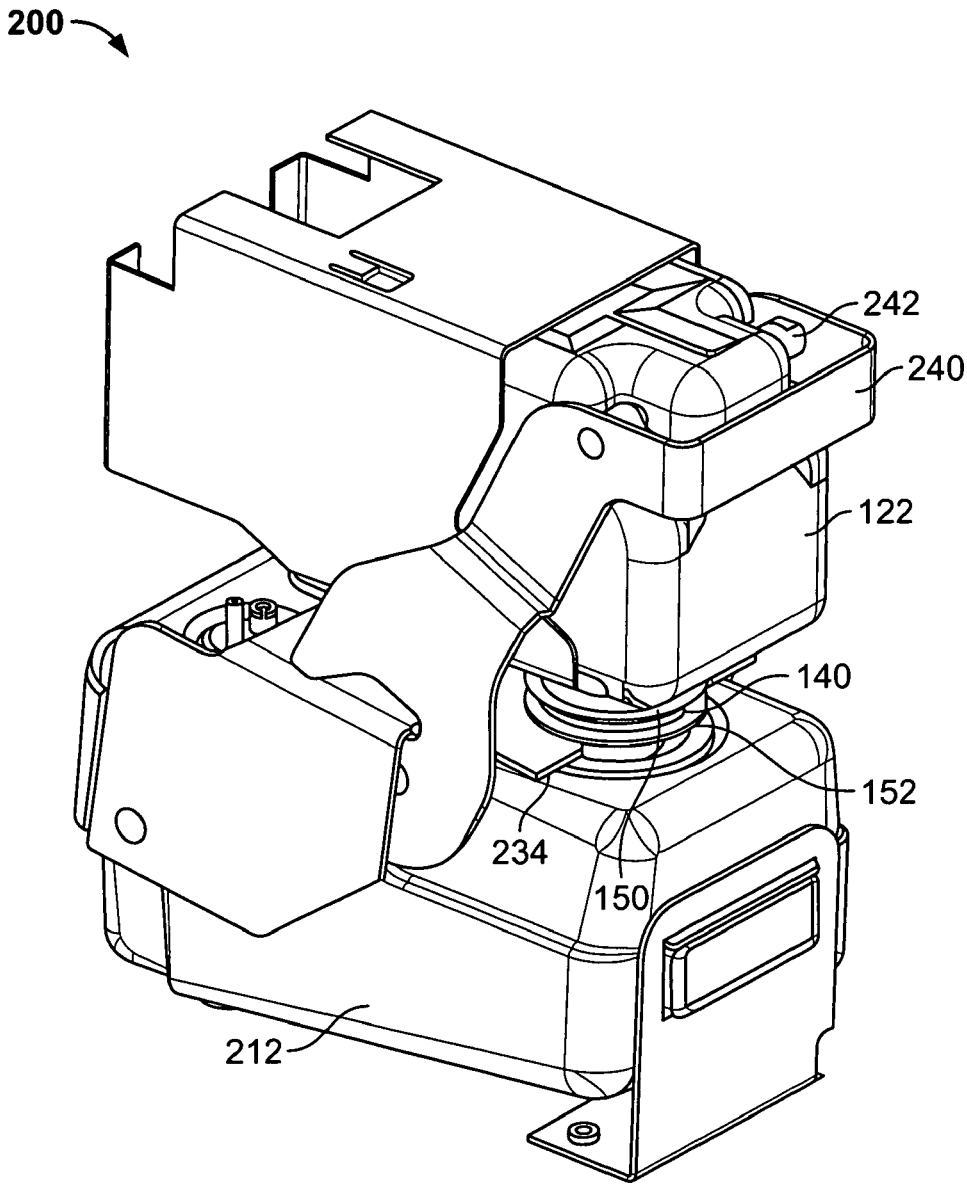
FIG. 20 illustrates an isometric view of an ink bottle connection system at a fully mated position, according to an embodiment of the present invention.

FIG. 20 illustrates an isometric view of the ink bottle connection system 200 at a fully mated position, according to an embodiment of the present invention. FIG. 21 illustrates an interior cross-sectional view of the ink bottle connection system 200 at a fully mated position, according to an embodiment of the present invention. As shown in FIGS. 20 and 21, the ridges 150 and 152 are spaced a nominal distance apart to allow a loose sliding fit with a fork on the lift/plate of the opening/closing mechanism.

Referring to FIGS. 20 and 21, the ink bottle 122 is guided into position by the use of a guide 232 to assure proper location with regard to a lift plate 234 and to some extent the positioning of the closure axially with respect to the probe. A spring member 236 is positioned below the probe assembly 231 in order to allow the bottle 122 to move vertically (with some nominal resistance less than the force required to disassemble the closure), and thereby allow any fitment tolerance in the engaging parts to be absorbed.

The system 200 shown in FIGS. 18-21 holds the bottle 122 rigid (in the bottle guide) and the cap assembly 140 is urged open and closed with respect to a probe 147 of the probe assembly 231. After the bottle 122 is inserted into the bottle guide 232 and the circumferential ridges 150 and 152 of the insert receptacle 140 are correctly positioned above and below the lift plate 234, the lever 240 is raised to a point whereby the lift plate 234 is posed to urge the cap assembly 140 open by exerting force into at least one of the ridges 150 and 152. Thereafter, continuing to raise the lever 240 affords a sufficient clearance to exist between the lever 240 and lift plate 234, thereby allowing force to be exerted downward on the lift plate 234 by two finger-like protrusions extending from the lever 240. The downward force on the lift plate 234 is sufficient to quickly force the cap assembly 140 to open the ink outlet passage 146. As the lever 240 is further raised, two cylindrical pins 242 extending inwardly from the lever 240 slidably engage the pin sliding surfaces 136, thereby locking the lever 240 into position.

The cap assembly 140 may be spring loaded to maintain probe/wiper-seal engagement throughout its range of motion also to assist in closing the ink outlet passage 146 as the lift plate 234 moves upward as the lever 240 is lowered. The cap assembly 140, in general, opens and closes similar to caps found on, for example, sports drink bottles, shampoo bottles, and dishwashing fluid bottles. That is, the cap is urged outwardly from the main body to allow liquid to pass therethrough, and is pushed into the main body to sealingly close the ink outlet passage 146.

The cap assembly 140 may be configured to snapably close. The snap indicates to an operator that the cap assembly 140 is closed, such that ink cannot pass therethrough. Thus, the operator will know that the ink bottle 122 may be safely removed from the ink reservoir 212.

Figure 22:
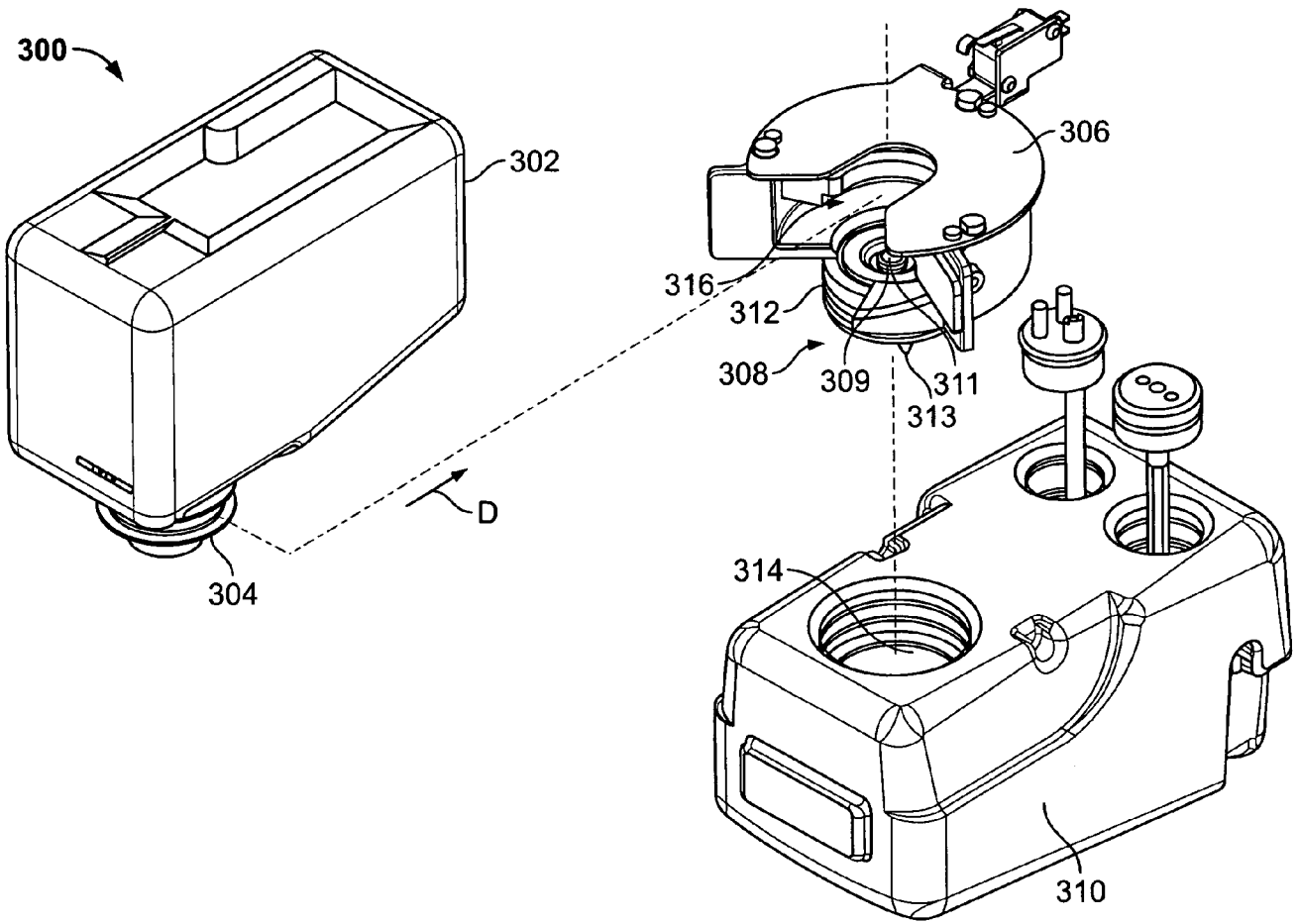
FIG. 22 illustrates an isometric exploded view of an ink bottle connection system, according to an embodiment of the present invention.

FIG. 22 illustrates an isometric exploded view of an ink bottle connection system 300, according to an embodiment of the present invention. The system 300 includes an ink bottle 302 having a cap assembly 304 secured about an outlet neck (not shown), a rotary actuator assembly 306 that may or may not be integrally formed with an insert receptacle 308, and an ink reservoir 310.

The rotary actuator assembly 306 is positioned above the ink reservoir 310 such that the main cylindrical body 312 of the insert receptacle 308 is securely mounted within an ink filling passage 314 of the ink reservoir 310. The insert receptacle 308 includes a probe 309 having an inlet end 311 positioned proximate an actuation chamber 316 of the rotary actuator assembly 306, and an outlet end 313 that is configured to be positioned within the ink reservoir 310 when the insert receptacle 308 is mounted within the ink filling passage 314.

The ink bottle 302 is moved toward the rotary actuator assembly 306 in the direction of arrow D, so that the cap assembly 304 is positioned within the actuation chamber 316 of the rotary actuator assembly 306. The rotary actuator assembly 306 is configured to selectively actuate the cap assembly 304 between open and closed positions.

Figure 23:
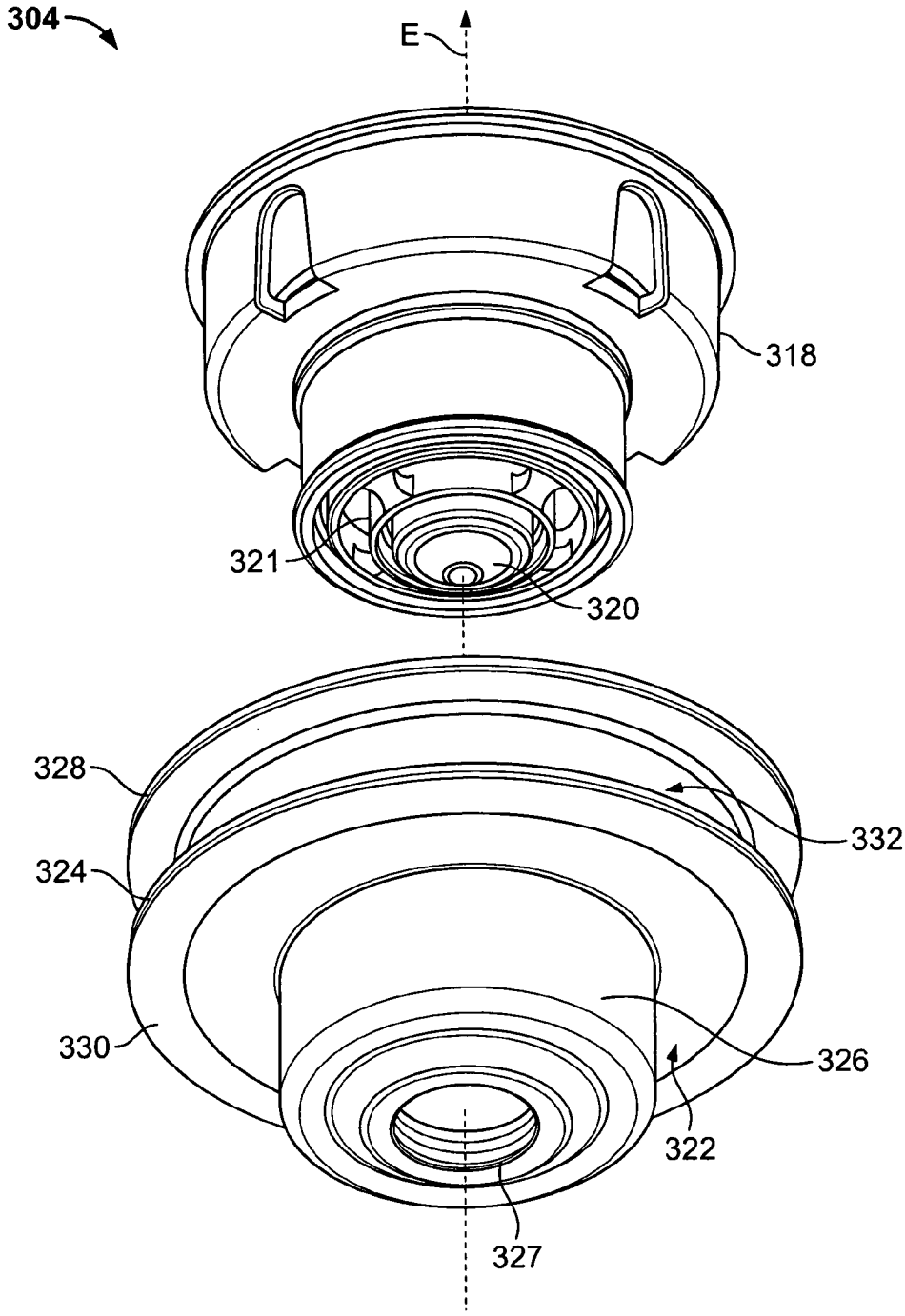
FIG. 23 illustrates an isometric exploded view of a cap assembly, according to an embodiment of the present invention.

FIG. 23 illustrates an isometric exploded view of the cap assembly 304. The cap assembly 304 includes a main body 318 having an outwardly extending central stud 320 with surrounding fluid passages 321 and a covering shell 322. The main body 318 includes a plurality of latches, clips, barbs, or the like, (shown below with respect to FIGS. 24 and 25) that are configured to snapably engage a corresponding structure (such as a ridge) formed on an exterior of the neck of the ink bottle 302 (shown in FIG. 22). As such, the cap assembly 304 is configured to be snapped onto the neck of the ink bottle 302. In particular, the cap assembly 304 is urged into the ink bottle 302 in the direction of arrow E in a linear manner, in order to secure the cap assembly 304 to the ink bottle 302. The cap assembly 304, however, is not screwed or rotated with respect to the ink bottle 302 in order to connect it thereto. Alternatively, the cap assembly 304 may be configured to threadably engage the neck of the ink bottle 302 so that the cap assembly 304 is screwed onto the neck.

The covering shell 322 is configured to be slidably retained over the main body 318. The covering shell 322 includes an actuator-receiving collar 324 integrally formed with a nozzle 326. The nozzle 326 includes an outlet 327 that is aligned with the central stud 320 of the main body 318. The actuator-receiving collar 324 includes an upper circumferential ridge or ledge 328 separated from a lower circumferential ridge or ledge 330 by a notch, channel, or groove 332. The cap assembly 140 shown with respect to FIGS. 10-17, for example, may be the same as the cap assembly 304.

Figure 24:
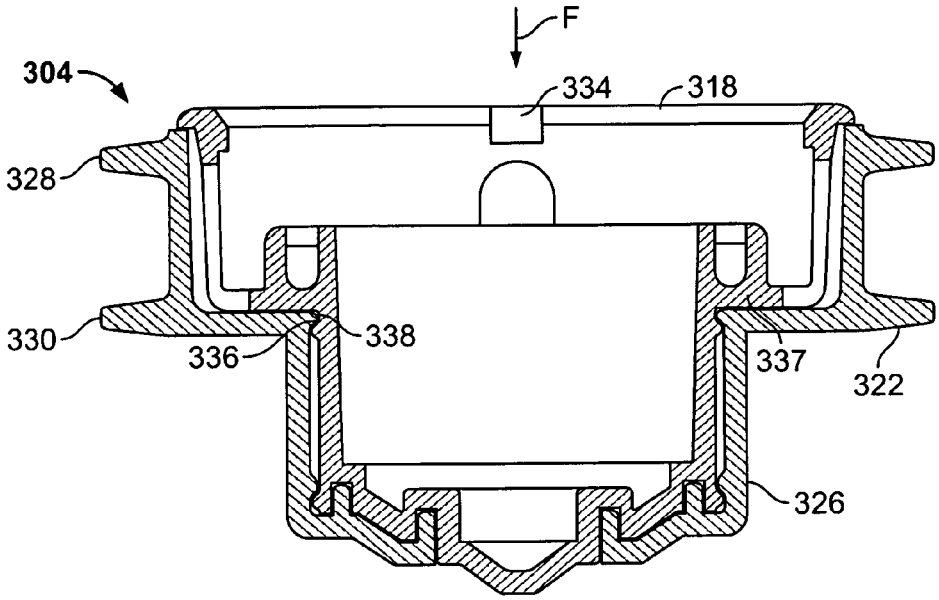
FIG. 24 illustrates a transverse cross-sectional view of a cap assembly in a closed position, according to an embodiment of the present invention.

FIG. 24 illustrates a transverse cross-sectional view of the cap assembly 304 in a closed position. As discussed above, the main body 318 includes a plurality of clips 334 configured to snapably engage a corresponding ridge formed on the neck (not shown) of the ink bottle 302 (shown in FIG. 22).

The covering shell 322 also includes a tab, protuberance, or ridge 336 formed proximate the base 337 of the nozzle 326. The ridge 336 extends inwardly toward the interior of the cap assembly 304 and is configured to be securely retained within a reciprocal, slot, divot, groove, or channel 338 formed within the main body 318, thereby securing the cap assembly 304 in a closed position. The cap assembly 304 may include a plurality of sealing members that ensure that fluid does not leak, seep, or otherwise exit from the closed cap assembly 304.

In order to open the cap assembly 304, the covering shell 322 is moved relative to the main body 318 in the direction of arrow F. The ridge 336 is configured to separate from the channel 338 upon exertion of sufficient force.

Figure 25:
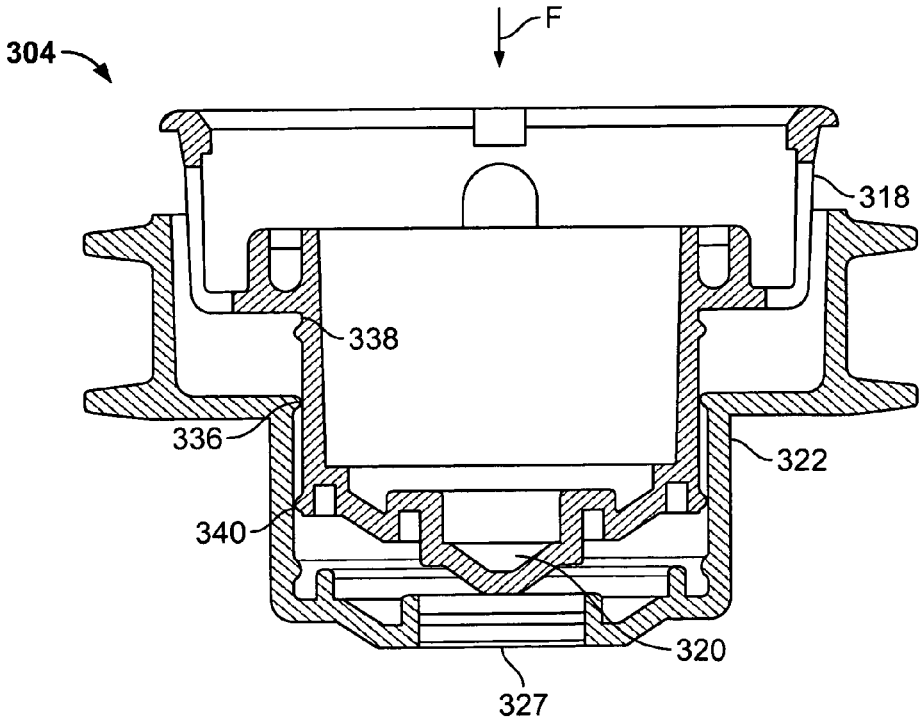
FIG. 25 illustrates a transverse cross-sectional view of a cap assembly in an open position, according to an embodiment of the present invention.

FIG. 25 illustrates a transverse cross-sectional view of the cap assembly 304 in an open position. As discussed above, the covering shell 322 is moved away from the main body 318 in the direction of arrow F. As the covering shell 322 is moved in the direction of arrow F, the ridge 336 is removed from the channel 338. Movement of the covering shell 322 is limited by a limit ridge 340 formed at a distal end of the main body 318. When the covering shell 322 is moved in the direction of arrow F such that the ridge 336 engages the limit ridge 340, movement of the covering shell 322 in the direction of arrow F with respect to the main body 318 is halted.

In the open position, fluid may pass from passages surround the central stud 320 of the main body into the outlet 327 of the covering shell 322, and thereby out of the cap assembly 304. In order to close the cap assembly 304, the covering shell 322 is moved back toward the main body 318 in the direction that is opposite arrow F until the channel 338 securely engages the ridge 336, and the outlet 327 sealingly engages around the circumference of the central stud.

Figure 26:
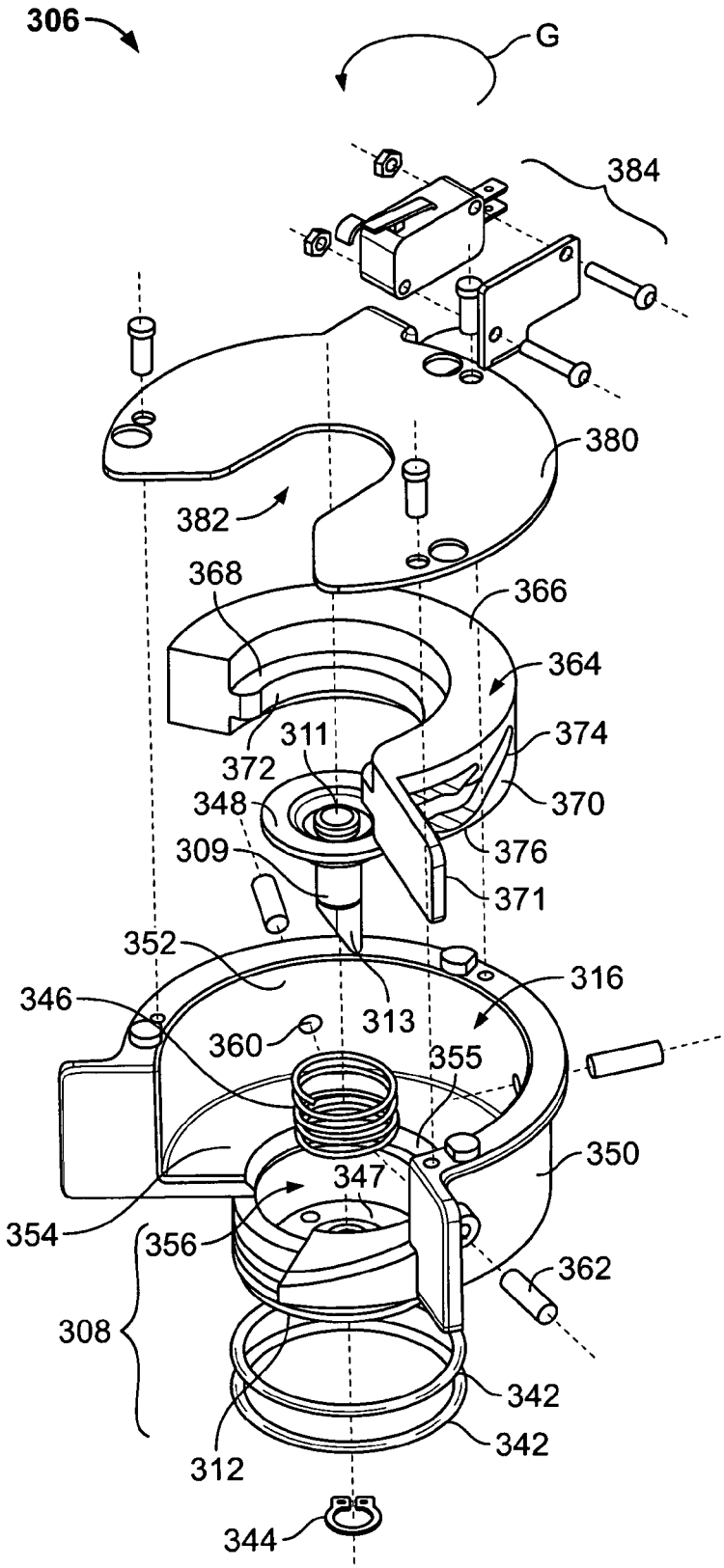
FIG. 26 illustrates an isometric exploded view of a rotary actuator assembly, according to an embodiment of the present invention.

FIG. 26 illustrates an isometric exploded view of the rotary actuator assembly 306. As discussed above, the rotary actuator assembly 306 may or may not be integrally formed with the insert receptacle 308. The insert receptacle 308 includes the main cylindrical body 312 having gaskets, o-rings, or other sealing members 342 mounted around an outer circumference thereof, and an outlet sealing member 344 configured to be positioned about an outer circumference of the outlet end 313 of the probe 309.

The probe 309 is configured to be secured within an interior of the main body 312 such that the outlet end 313 extends downwardly from the main body 312, and the inlet end 311 extends upwardly into the interior of the main body 312. A spring 346 may be positioned between a base 347 of the main body 312 and a collar 348 of the probe 309, in order to assist in closing the cap assembly 304 (shown with respect to FIGS. 22-25) during a closing operation.

The actuator assembly 306 includes a main semi-cylindrical housing 350 having lateral walls 352 integrally formed with a base 354, defining the actuation chamber 316 therebetween. The base 354 includes an edge 355 defining an opening 356. The base 354 connects to, or is integrally formed with, an upper circumferential edge of the main body 312 of the insert receptacle 308.

Passages 360 are formed through the lateral walls 352. The passages 360 are configured to receive and retain actuator guide cylinders (bolts, screws, or the like) 362 that extend into the actuation chamber 316.

An actuator 364 is rotatably secured within the actuation chamber 316. The actuator 364 includes a semi-circular wall 366 having an inner surface 368 and an outer surface 370. An inwardly-extending protrusion 372, such as an inner circumferential ridge, is formed along the interior circumference of the inner surface 368. Guide channels 374 and 376 are formed in the outer surface 370 and are configured to cooperate with the guide cylinders 362 in order to move the actuator 364 in vertical directions within the actuation chamber 316 as the actuator 364 is rotated through directions denoted by arrows G. A handle 371 extends outwardly from an end of the wall 366, and is configured to allow a user to rotate the actuator 364 through directions denoted by arrows G.

A guide sleeve 380 is secured to the main housing 350 over the actuation chamber 316. The guide sleeve 380 includes a neck-receiving channel 382 that is configured to receive and retain the neck (not shown). A locating member 384 configured to align and stabilize the actuator assembly 306 is secured to the guide sleeve 380.

Figure 27:
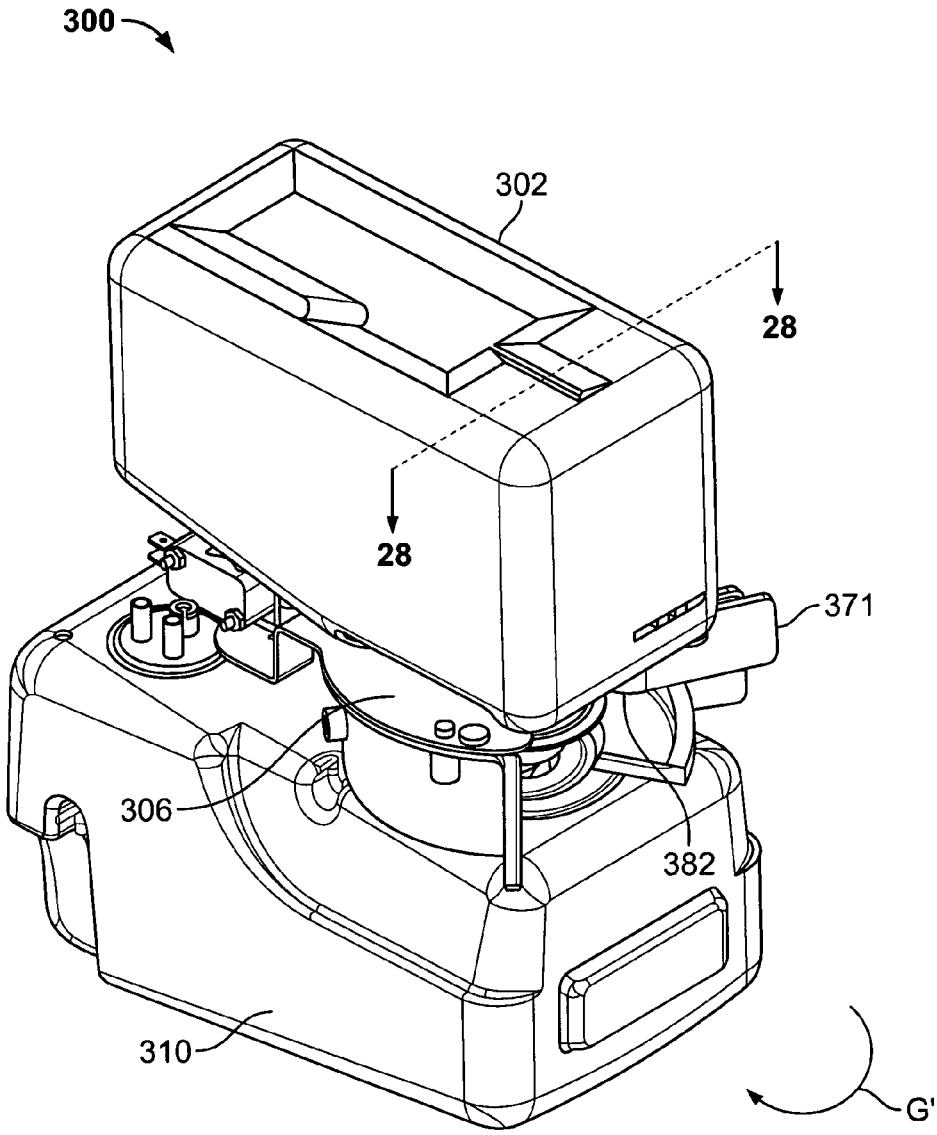
FIG. 27 illustrates an isometric view of an ink bottle connection system during a pre-mating stage, according to an embodiment of the present invention.

FIG. 27 illustrates an isometric view of the ink bottle connection system 300 during a pre-mating stage. The ink bottle 302 is secured within the actuator assembly 306 by way of the neck (not shown) being secured within the neck-receiving channel 382. In order to fully mate the ink bottle 302 to the ink reservoir 310, the handle 371 is rotated in the direction of G'.

Figure 29:
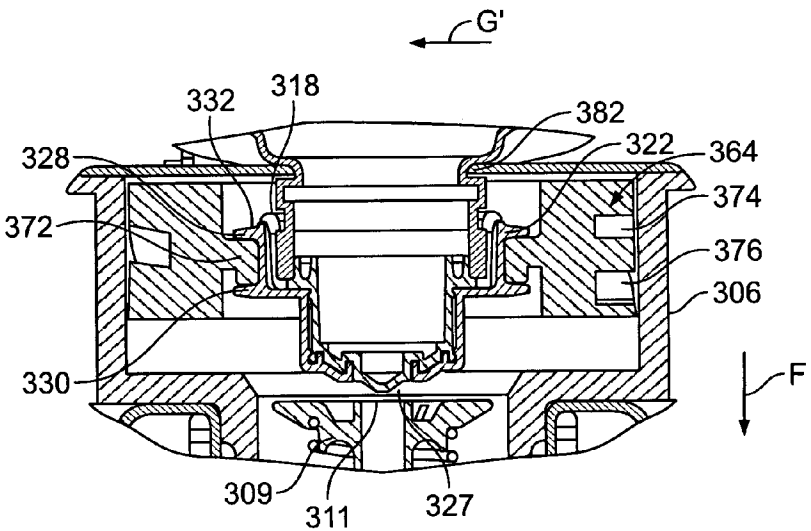
FIG. 29 illustrate a transverse cross-sectional close-up view of a cap assembly and probe during a pre-mating stage, according to an embodiment of the present invention.
Figure 28:
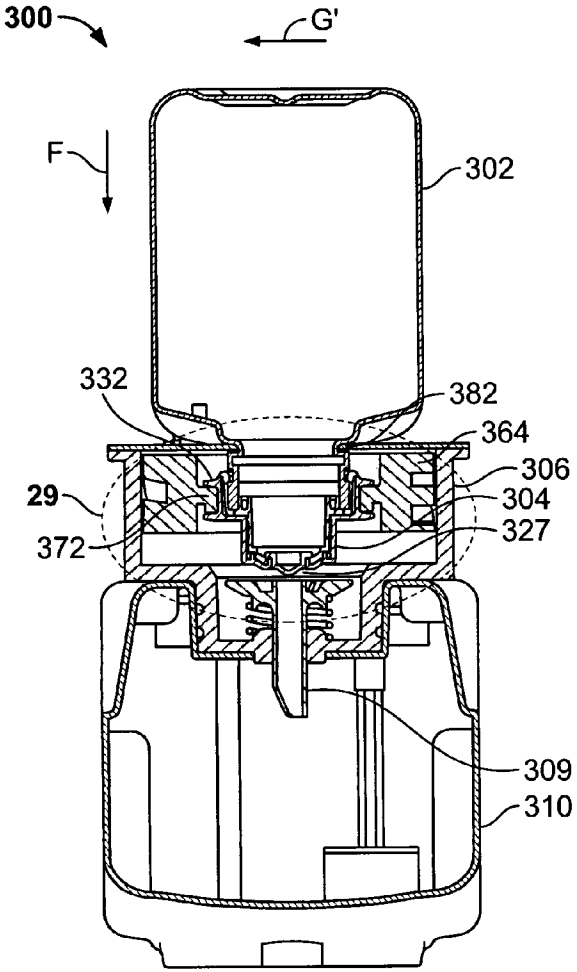
FIG. 28 illustrates a transverse cross-sectional view through line 28-28 of FIG. 27 of an ink bottle connection system during a pre-mating stage, according to an embodiment of the present invention.

FIG. 28 illustrates a transverse cross-sectional view through line 28-28 of FIG. 27 of the ink bottle connection system 300 during the pre-mating stage. FIG. 29 illustrates a transverse cross-sectional close-up view of the cap assembly 304 and the probe 309 during the pre-mating stage. As shown in FIGS. 28 and 29, the protrusion 372 is slidably retained within the groove 332 defined by the upper and lower ridges 328 and 330 of the covering shell 322. Also, as shown in FIGS. 28 and 29, the neck-receiving channel 382 ensures that the outlet 327 of the cap assembly 304 is properly aligned with the inlet end 311 of the probe 309.

In order to mate the cap assembly 304 with the probe 309, the handle 371 (shown, e.g., in FIGS. 26 and 27) is rotated in a rotary direction denoted by G'. As the handle 371 is rotated, the entire actuator 364 rotates along with the handle 371. The guide cylinders 362 (shown in FIG. 26) cooperate with the guide cylinder channels 374 and 376 to urge the actuator 364, and therefore the covering shell 322 downward in the direction of arrow F toward the probe 309.

Figure 30:
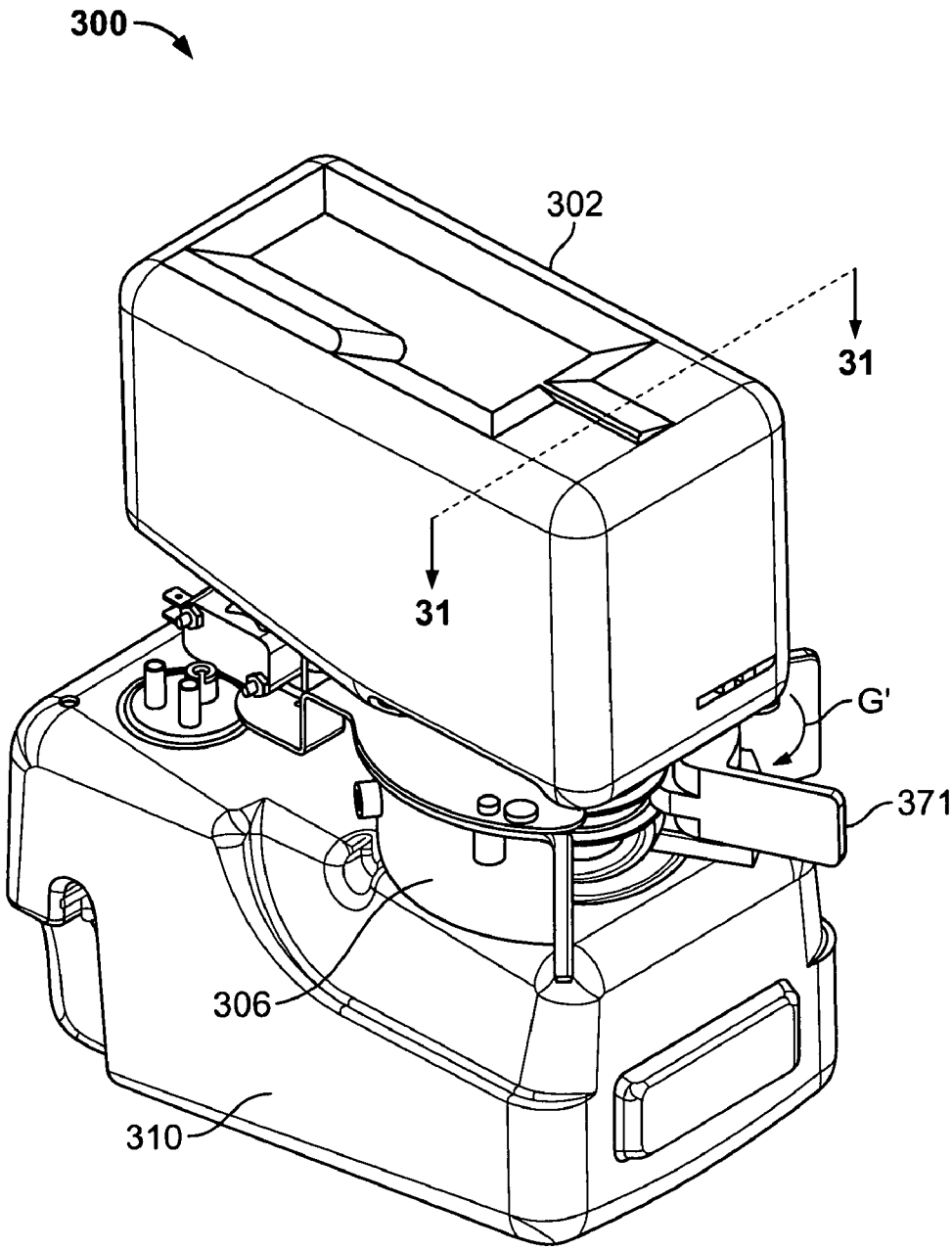
FIG. 30 illustrates an isometric view of an ink bottle connection system during a mated stage, according to an embodiment of the present invention.

FIG. 30 illustrates an isometric view of the ink bottle connection system 300 during a fully mated stage. The handle 371 has been urged in the direction of G' to fully mate the ink bottle 302 with the ink reservoir 310, such that the cap assembly 304 (hidden in FIG. 30) is open and mated with the probe 309 (hidden in FIG. 30), thereby allowing fluid to pass from the ink bottle 302 to the ink reservoir 310.

Figure 32:
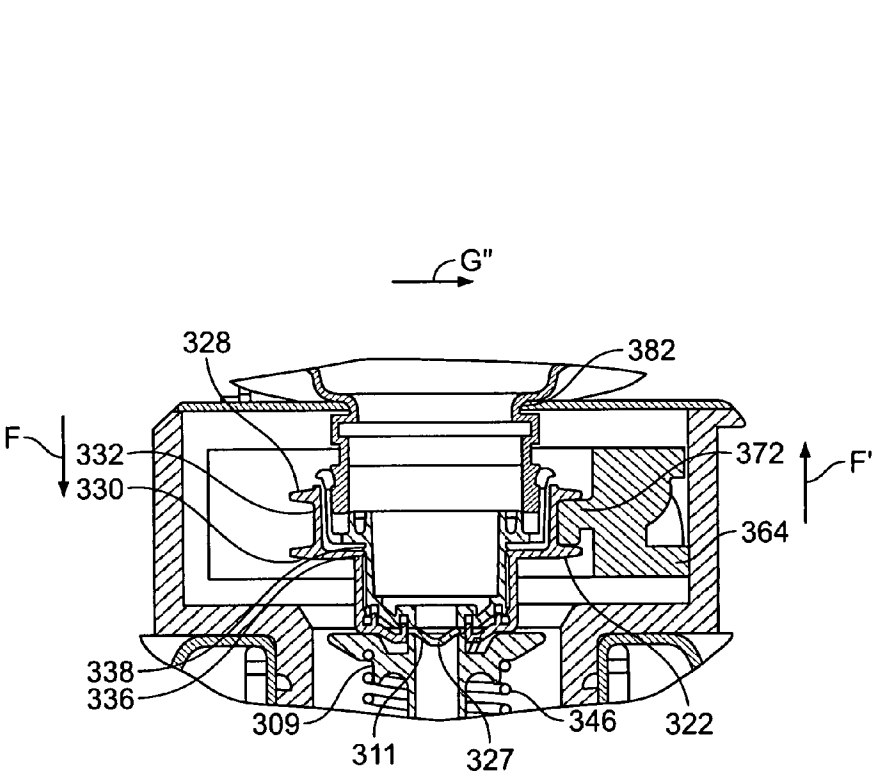
FIG. 32 illustrate a transverse cross-sectional close-up view of a cap assembly and probe during a mated stage, according to an embodiment of the present invention.
Figure 31:
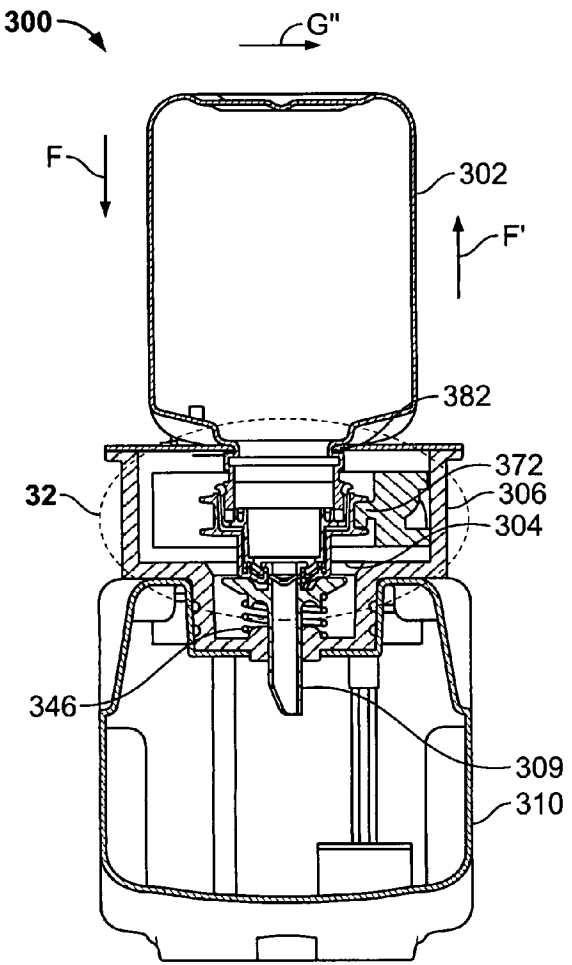
FIG. 31 illustrates a transverse cross-sectional view through line 31-31 of FIG. 30 of an ink bottle connection system during a mated stage, according to an embodiment of the present invention.

FIG. 31 illustrates a transverse cross-sectional view through line 31-31 of FIG. 30 of the ink bottle connection system 300 during the fully mated stage. FIG. 32 illustrate a transverse cross-sectional close-up view of the cap assembly 304 and probe 309 during the fully mated stage. As shown in FIGS. 31 and 32, the actuator 364 has been rotated to open the cap assembly 304, thereby shifting the actuator 364 and the covering shell 322 downward toward the probe 309 in the direction of arrow F. As such, the outlet 327 of the opened cap assembly 304 is mated into the inlet end 311 of the probe 309. The inlet end 311 of the probe 309 is configured to conform to the contours of the distal end of the covering shell 322, thereby forming a sealing engagement therebetween when the covering shell 322 is mated into the inlet end 311 of the probe 309.

In order to remove the covering shell 322 from the probe 309, the handle 371 (shown in FIG. 30) is rotated in the direction of G", thereby moving the actuator 364 in the same direction. The guide cylinders 362 (shown in FIG. 26) cooperate with the guide channels 374 and 376 to move the actuator 364, and therefore the covering shell 322, away from the probe 309 in the direction of arrow F' until the ridge 336 of the covering shell 322 is snapably engaged into the channel 338 of the main body 318 of the cap assembly 304 (as discussed above with respect to FIGS. 24 and 25), thereby closing the cap assembly 304.

During a fully mated position, the spring 346 may be compressed due to the force of the covering shell 322 being mated into the probe 309. As mentioned above, the spring 346 exerts a force in the opposite direction to that of the mating force. As such, when the system 300 is disconnected, i.e., when the covering shell 322 is actuated away from the probe 309, the spring 346 exerts a force in the direction of F' into the probe, thereby assisting in pushing the covering shell 322 back into a closed position.

Embodiments of the present invention provide a more efficient system and method of connecting an ink bottle to an ink reservoir of an ink jet printing system. Embodiments of the present invention provide a system and method of minimizing fluid leaks and mess caused by the positioning and disengagement of an ink bottle on an ink reservoir.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An ink supply system for an ink jet printer, comprising:

an ink bottle having a cap assembly secured to an outlet neck;

an ink reservoir having an ink filling passage;

an insert receptacle positioned within said ink filling passage, wherein said insert receptacle comprises a probe having an inlet end and an outlet end, a base integrally formed with a wall defining an inner cavity therebetween, said probe having an ink passage positioned through said base; and an actuating assembly that is configured to mate said ink bottle with said ink reservoir by mating said cap assembly of said ink bottle with said probe of said insert receptacle, wherein said actuating assembly is also configured to disconnect said ink reservoir and said ink bottle when mated together by disconnecting said cap assembly from said probe, said actuating assembly comprising an ink bottle securing member configured to pivot with respect to said ink reservoir, said ink bottle securing member supporting said ink bottle above said ink reservoir in a first position, and said ink bottle securing member pivoting to a second position to mate said ink bottle with said ink reservoir, said probe being configured to pass ink from said ink bottle to said ink reservoir after said ink bottle securing member pivots to said second position.

2. The system of claim 1, wherein said cap assembly is closed in a pre-mated position, and wherein said cap assembly is opened when said ink bottle is mated with said ink reservoir.

3. The system of claim 2, wherein said cap assembly comprises a main body having a central stud and a covering shield having an outlet, wherein said covering shield is movably secured over said main body, wherein said central stud sealingly engages said outlet in said pre-mated position, and wherein said covering shield is moved so that said outlet is moved away from said central stud when said ink bottle is mated with said ink reservoir.

4. The system of claim 2, wherein said cap assembly further comprises a main body and sealing members.

5. The system of claim 1, wherein said cap assembly includes at least one clip, and wherein said neck includes a ridge, wherein said at least one clip snapably engages said ridge to secure said cap assembly to said neck.

6. The system of claim 1, wherein said actuating assembly moves at least a portion of said cap assembly into said probe.

7. The system of claim 1, further comprising an ink bottle positioning member configured to align said cap assembly with said probe.

8. The system of claim 7, wherein said cap assembly comprises first and second circumferential ridges, and wherein said ink bottle positioning member is configured to be positioned between at least a portion of said first and second circumferential ridges.

9. The system of claim 1, wherein said ink bottle securing member pivots about a horizontal axis.

10. The system of claim 1, wherein said insert receptacle further comprises an ink drain formed through said base, said ink drain allowing excess ink retained within said inner cavity to pass into said ink reservoir.

11. The system of claim 10, wherein said sealing members are diaphragms, and said probe slidably engages said diaphragms when said ink bottle is mated into said ink reservoir, and wherein said diaphragms sealingly engage said probe when said ink bottle is mated into said ink reservoir.

12. The system of claim 1, wherein said cap assembly further comprises at least one seal member configured to seal against ink leakage when said cap assembly is in said closed position.

13. The system of claim 1, further comprising at least one spring member positioned within said insert receptacle that assists in closing to close said insert cap assembly when said ink bottle is removed from said ink reservoir.

14. The system of claim 1, further comprising at least one spring member that acts to push said ink bottle away from said reservoir when said ink bottle is removed from said ink reservoir.

15. The system of claim 1, wherein said ink bottle securing member includes pins that slidably engage curved surfaces formed on said ink bottle, said pins sliding over said curved surfaces toward said second position thereby urging said ink bottle toward said ink reservoir.

16. The system of claim 1, wherein said ink bottle securing member includes at least one bottle ejection member that supports said ink bottle above said ink reservoir in said first position.

17. The system of claim 1, further comprising a bracket having a locating protuberance, and wherein said ink bottle includes a locating feature that is configured to mate with said locating protuberance so that said ink bottle is properly secured within said bracket.

18. The system of claim 17, wherein said locating feature is a recessed area.

19. The system of claim 18, wherein said recessed area is located proximate an upper portion of said ink bottle.

20. The system of claim 1, wherein said cap assembly comprises a main body, a washer-like diaphragm and a split diaphragm, wherein said probe slidably engages said diaphragms when said ink bottle is mated with said ink reservoir, and wherein said diaphragms sealingly engage said probe when said ink bottle is mated with said ink reservoir.

21. The system of claim 20, wherein said washer-like diaphragm is sandwiched between a surface of said main body of said outlet cap and said split diaphragm.

22. The system of claim 20, wherein said split diaphragm includes a partially formed slit, wherein said probe punctures said partially formed slit to form an opening when said probe slidably engages said split diaphragm.

23. The system of claim 22, wherein said opening closes when said probe is removed from said split diaphragm.

24. An ink supply system for an ink jet printer, comprising:

an ink bottle containing ink, an ink reservoir;

an ink bottle positioning member configured to align said ink bottle in a pre-mated position with said ink reservoir, said ink bottle positioning member configured to pivot with respect to said ink reservoir in a first direction to said pre-mated position; and an actuating assembly comprising an ink bottle securing member configured to pivot with respect to said ink reservoir, said ink bottle securing member supporting said ink bottle above said ink reservoir in a first position, and said ink bottle securing member pivoting to a second position to mate said ink bottle with said ink reservoir, wherein the ink passes from said ink bottle to said ink reservoir when said ink bottle securing member mates said ink bottle with said ink reservoir.

25. A method of connecting an ink bottle to an ink reservoir of an ink jet printer, comprising:

pivoting an ink bottle positioning member relative to the ink reservoir in a first direction so that the ink bottle, which is retained by the ink bottle positioning member, is in an pre-mated position with the ink reservoir, wherein a mating feature of the ink bottle is aligned with a mating feature of the ink reservoir; and supporting the ink bottle above the ink reservoir in a first position through an ink bottle securing member;

actuating the ink bottle into a fully mated position with the ink reservoir by pivoting the ink bottle securing member with respect to the ink reservoir in a second direction to a second position, wherein said pivoting causes the ink bottle securing member to slide over a portion of the ink bottle, thereby exerting sufficient force to mate the ink bottle with the ink reservoir; and passing ink from the ink bottle to the ink reservoir when the ink bottle is mated with the ink reservoir.

26. An ink supply system for an ink jet printer, comprising:

an ink bottle having a cap assembly secured to an outlet neck, said cap assembly comprising a fixed interior body, and a moveable covering shield positioned over said fixed interior body, said covering shield comprising a groove;

an ink reservoir having an ink filling passage;

an insert receptacle positioned within said ink filling passage, wherein said insert receptacle comprises a probe having an inlet end and an outlet end; and an actuating assembly comprising an actuator comprising a wall having an inner surface and an outer surface, wherein a protrusion extends inwardly from said inner surface, said actuating assembly being configured to mate said ink bottle with said ink reservoir by mating said cap assembly of said ink bottle with said probe of said insert receptacle, wherein said actuating assembly is also configured to disconnect said ink reservoir and said ink bottle when mated together by disconnecting said cap assembly from said probe, wherein said groove of said covering shield receives and retains said protrusion, and wherein said movement of said actuator causes a corresponding movement in said covering shield relative to said interior body.

27. The system of claim 26, wherein said actuator is semicircular, and wherein said actuator is rotated about a vertical axis in order to mate said ink bottle with said ink reservoir.

28. The system of claim 26, wherein said actuating assembly further comprises a main housing having inwardly-extending guide members, wherein said actuator is rotatably retained within said main housing, and wherein said outer surface of said actuator comprises at least one guide channel configured to moveably retain said guide members.

29. An ink supply system for an ink jet printer, comprising:

an ink bottle having a cap assembly secured to an outlet neck;

an ink reservoir having an ink filling passage;

an insert receptacle positioned within said ink filling passage, wherein said insert receptacle comprises a probe having an inlet end and an outlet end; and an actuating assembly that is configured to mate said ink bottle with said ink reservoir by mating said cap assembly of said ink bottle with said probe of said insert receptacle, wherein said actuating assembly is also configured to disconnect said ink reservoir and said ink bottle when mated together by disconnecting said cap assembly from said probe, said actuating assembly comprising an ink bottle securing member configured to pivot with respect to said ink reservoir, said ink bottle securing member supporting said ink bottle above said ink reservoir in a first position, and said ink bottle securing member pivoting to a second position to mate said ink bottle with said ink reservoir, said ink bottle securing member comprising pins that slidably engage curved surfaces formed on said ink bottle, said pins sliding over said curved surfaces toward said second position thereby urging said ink bottle toward said ink reservoir.

* * * * *